US005691489A

United States Patent [19]

Fujiwara et al.

[11] Patent Number: 5,691,489

[45] Date of Patent: Nov. 25, 1997

[54] AUTOMATIC PLAYER PIANO EXACTLY REPRODUCING HALF STROKE IN PLAYBACK

[75] Inventors: Yuji Fujiwara; Yasuhiko Oba; Jun Yamamoto, all of Shizuoka, Japan

[73] Assignee: Yamaha Corporation, Japan

[21] Appl. No.: 712,962

[22] Filed: Sep. 12, 1996

[30] Foreign Application Priority Data

Sep. 19, 1995 [JP] Japan ..... 7-240324

[51] Int. Cl.[6] ..... G10F 1/02; G10F 5/02; G10G 3/04

[52] U.S. Cl. ..... 84/21; 84/115; 84/462

[58] Field of Search ..... 84/2, 3, 19–23, 84/171, 115, 462, 615, 626, 658, 687–690, 719, 720, 744, 745, 423 R, 433, DIG. 7

[56] References Cited

U.S. PATENT DOCUMENTS 5,254,804 10/1993 Tamaki et al. ..... 84/658 X

*Primary Examiner*—Stanley J. Witkowski

*Attorney, Agent, or Firm*—Graham & James LLP

[57] ABSTRACT

An automatic player piano controls a solenoid-operated key actuator so as to move a key along a quadratic curve around a turning point where the key changes the direction of the motion, and the solenoid-operated key actuator faithfully reproduce a half stroke key motion.

8 Claims, 17 Drawing Sheets

AUTOMATIC PLAYER PIANO EXACTLY REPRODUCING HALF STROKE IN PLAYBACK

FIELD OF THE INVENTION

This invention relates to an automatic player piano and, more particularly, to an automatic player piano exactly reproducing half stroke in a playback.

DESCRIPTION OF THE RELATED ART

An automatic player piano is a piano-like keyboard musical instrument equipped with an electric key actuation system. Solenoid-operated key actuators are provided under the keyboard, and a controller selectively energizes the solenoid-operated key actuators. When the controller energizes a solenoid-operated key actuator, the solenoid-operated key actuator projects the plunger, and pushes an associated key. The key turns as if a player depresses it, and causes the key action mechanism to rotate the hammer toward a set of strings. The hammer strikes the set of strings, and the strings vibrate so as to generate an acoustic piano sound.

The loudness of the acoustic piano sound is proportional to the intensity of the impact against the set of strings, and the intensity of the impact is dependent on the hammer velocity before the strike. The hammer velocity is controllable with the amount of driving current supplied to the associated solenoid-operated key actuator. For this reason, the controller changes the amount of driving current in proportion to the loudness of the acoustic piano sound to be expected by using a pulse width modulation technique.

If the automatic player piano is capable of recording an original performance on the keyboard, a hammer sensor monitors the hammer, and the controller determines the hammer velocity just before the set of strings on the basis of the hammer motion reported by the hammer sensor. The hammer velocity is coded into a music data code.

The acoustic piano sounds sequentially take place during the original performance, and the controller measures time interval between every two acoustic piano sounds, and each time interval is coded into the music data code. The controller may measure the lapse of time from the starting point for each acoustic piano sound so as to introduce it into the music data code.

The controller selectively supplies the driving current equivalent to each hammer velocity to the solenoid-operated key actuators at time intervals represented by the music data codes in the playback. If the controller starts to energize the solenoid-operated actuator at the expire of the time interval, the generation of the acoustic piano sound is too late, because the a series of mechanical motions consumes time. For this reason, the controller starts to energize the solenoid-operated actuator before the expire of the time interval. However, the time interval consumed until the sound generation is not constant. If the music data code requests a large hammer velocity, the controller supplies a large amount of driving current to the solenoid-operated actuator, and the time interval until the sound generation is relatively short. On the other hand, if the music data code requests a soft sound, the controller supplies a small amount of driving current to the solenoid-operated actuator, and the time interval until the sound generation is relatively long. For this reason, the controller varies the time interval depending upon the hammer velocity or the loudness of the acoustic piano sound to be requested.

While the player is performing on the keyboard, key sensors monitor the keys, and the controller determines a terminatory timing for each acoustic piano sound. The terminatory timing is also coded into a music data code. The controller is responsive to the music data code representing the terminatory timing during the playback, and stops the driving current slightly before the terminatory timing. Thus, the controller successively generates the music data codes representative of the depressed keys, the respective hammer velocities, the time intervals between every two acoustic piano sounds and the terminatory timings in the recording, and selectively energizes and deenergizes the solenoid-operated key actuators during the playback.

The player depresses and releases the keys in various ways. The standard key motion starts at the rest position, and is terminated at the end position. However, there is a key motion called "half stroke". When the player releases the key before the end position or depresses the key on the way to the rest position, the half stroke takes place.

The prior art controller does not take the half stroke into account, and the half stroke is not exactly reproduced in the playback. Especially, when a player repeats the half stroke, the prior art electric key actuation system hardly reproduce the complex key motion.

Fujiwara et. al. proposed a concept for reproducing the half stroke, and is disclosed in U.S. Ser. No. 08/356,871 filed on Dec. 15, 1994. Fujiwara is one of the inventors who made the present invention. According to the specification of U.S. Ser. No. 08/356,871, assuming now that a player depresses a key on the way from the end position to the rest position, the controller reproduces the half stroke as follows. The controller determines a first trajectory from the rest position to the end position for the forward motion and a second trajectory from the end position to the rest position for the backward motion, and estimates a time when the first trajectory crosses the second trajectory. The first trajectory is simply combined with the second trajectory at the time, and the controller controls the key along the composite trajectory.

However, the controlling method previously proposed by Fujiwara encounters the following problems. First, when the controller changes the backward motion to the forward motion, the key rebounds on the plunger of the associated solenoid-operated actuator, and the solenoid-operated actuator gives an excess velocity to the key and, accordingly, the hammer. The excess hammer velocity results in unexpectedly strong piano sound.

Second, even though the controller supplies the driving current signal to the solenoid-operated actuator, the key is not changed from the backward motion to the forward motion. The undesirable phenomenon takes place when the force generated by the solenoid-operated actuator is smaller than the force of inertia. The unchanged key motion results in a missing sound or a sound out of the rhythm.

Third, when a player repeats a key around the end position in an original performance, the damper is imperfectly brought into contact with the vibrating strings, and the piano sound becomes loud. However, the previously proposed controlling method hardly reproduces the quick repetition, because the solenoid-operated actuator can not repeat the reciprocal motion in a narrow range.

Fourth, the solenoid-operated actuator moves the key so fast that the key motion is unnatural.

SUMMARY OF THE INVENTION

It is therefore an important object of the present invention to provide a keyboard musical instrument which is free from the problems inherent in the automatic player piano previously proposed.

To accomplish the object, the present invention proposes to assume the trajectory of a key around a turning point to be a quadratic curve.

In accordance with the present invention, there is provided an automatic player piano comprising: an acoustic piano including a keyboard having a plurality of keys respectively assigned notes of a scale and turnable between respective rest positions and respective end positions when a player selectively depresses and releases through a fingering, a plurality of vibrating means respectively associated with the plurality of keys for generating acoustic sounds with notes of the scale assigned to depressed keys, a plurality of hammer assemblies respectively associated with the plurality of vibrating means so as to cause vibrating means associated with the depressed keys to generate the acoustic sounds, a plurality of key action mechanisms coupled between the plurality of keys and the plurality of hammer assemblies, and selectively actuated by the depressed keys so as to selectively cause the plurality of hammer assemblies to strike the plurality of hammer assemblies, and a plurality of damper assemblies respectively associated with the plurality of vibrating means and selectively brought into contact with the vibrating means at respective return points for absorbing vibrations after the depressed keys are released; and an automatic playing system including a plurality of key actuators respectively associated with the plurality of keys and responsive to driving signals so as to cause the plurality of keys to selectively turn without the fingering, a playback sub-system responsive to music data codes containing a first piece of data information representative of one of the plurality of keys, a second piece of data information representative of a hammer velocity expected to associated one of the plurality of hammer assemblies, a third piece of data information representative of an impact timing of the aforesaid one of the hammer assemblies against associated one of the vibrating means, a fourth piece of data information representative of a key velocity of the aforesaid one of the plurality of keys on the way toward the rest position and a fifth piece of data information representative of a return time when associated one of the plurality of damper assemblies is brought into contact with the associated one of the plurality of vibrating means for generating one of the driving signal, the playback sub-system having a first trajectory generating means responsive to the second to fifth pieces of data information for determining a first trajectory from the rest position through a transit point to the end position and a second trajectory from the end position through the transit point to the rest position, a second trajectory generating means for producing a decelerating trajectory integral with the first trajectory at the transit point and an accelerating trajectory. integral with the second trajectory at the transit point on the basis of the second to fifth pieces of data information, a judging means for deciding whether or not the decelerating trajectory crosses the accelerating trajectory before the aforesaid one of the plurality of keys reaches the end position, a composing means for producing a composite trajectory having the decelerating trajectory integral with the accelerating trajectory at a turning point where the aforesaid one of the plurality of keys changes the direction of a motion when the judging means decides the decelerating trajectory crosses the accelerating trajectory, and a driving current supplying means for producing the driving signals, each of the driving signals being representative of the first and second trajectories when the judging means decides that the decelerating trajectory does not cross the accelerating trajectory, each of the driving signals being representative of a composite trajectory integral with a part of the first trajectory and a part of the second trajectory at the transit point when the composing means produces the composite trajectory.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENTS

First Embodiment

Structure of Automatic Player Piano

Figure 1:
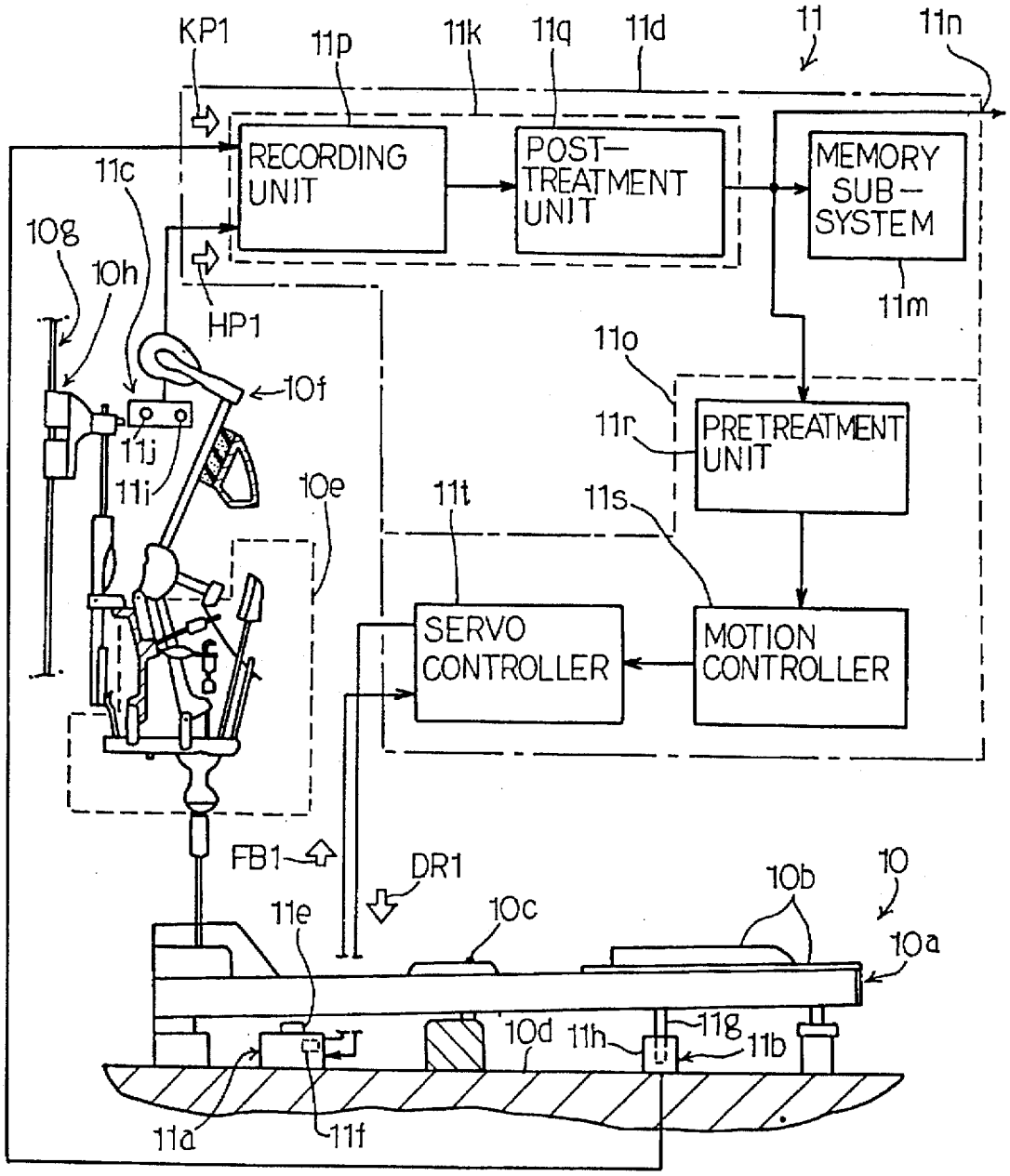
FIG. 1 is a schematic side view showing an automatic player piano according to the present invention.

Referring first to FIG. 1 of the drawings, an automatic player piano embodying the present invention largely comprises an acoustic piano 10 and an automatic player system 11.

The acoustic piano 10 is an upright piano, and largely comprises a keyboard 10*a* implemented by a plurality of keys 10*b* turnably supported by a balance key pin 10*c* on a key bed 10*d*. Each of the keys 10*b* turns between a rest position to an end position around the balance key pin 10*c* when a player depresses it. Notes of a scale are respectively assigned to the keys 10*b*, and key codes respectively represent the notes of the scale.

The acoustic piano 10 further comprises a plurality of key action mechanisms 10*e* functionally connected to the keys 10*b*, respectively, a plurality of hammer assemblies 10*f* respectively driven for rotation by the key action mechanisms 10*e*, a plurality of sets of strings 10*g* respectively struck by the hammer assemblies 10*f* and a plurality of damper assemblies 10*h* actuated by the key action mechanisms 10*e* for temporarily leaving the associated sets of strings 10*g*. The acoustic piano 10 is similar to a standard upright piano, and the key action mechanism 10*e*, the hammer assembly 10*f*, the strings 10*g* and the damper assembly 10*h* behave as similar to those of the standard upright piano which are well known to a person skilled in the art. For this reason, no further description is incorporated hereinbelow.

The automatic playing system 11 comprises a plurality of solenoid-operated actuator units 11*a* provided under the keys 10*b* and having respective plungers 11*e* protectable for rotating the associated keys 10*b* around the balance key pins 10*c* instead of the player and a controller 11*d* connected to the solenoid-operated actuator units 11*a*. Each of the solenoid-operated actuator unit 11*a* has a built-in position sensor for reporting an actual position of the plunger 11*e* to the controller 11*d*.

The automatic playing system 11 comprises a plurality of solenoid-operated actuator units 11*a* respectively provided under the keys 10*b*, a plurality of key sensors 11*b* also provided under the keys 10*b*, a plurality of hammer sensors 11*c* respectively associated with the hammer assemblies 10*f* and a controller 11*d* connected to the solenoid-operated actuator units 11*a*, the key sensors 11*b* and the hammer sensors 11*c*.

Each of the solenoid-operated actuator units 11*a* has a plunger 11*e* upwardly pushing the associated key 10*b* and a built-in position sensor 11*f* for monitoring the plunger 11*e*, and the built-in position sensor 11*f* generates a feedback signal FB1 indicative of an actual position of the plunger 11*e*.

Each of the key sensors 11*b* is implemented by a shutter plate 11*g* attached to the lower surface of the associated key 10*b* and a plurality of photo-couplers 11*h*. A slit pattern (not shown) is formed in the shutter plate 11*g*. The plurality of photo-couplers 11*h* are provided along the trajectory of the shutter plate 11*g*, and are spaced by a predetermined distance.

When the key 10*b* is depressed, the shutter plate 11*g* is downwardly moved, and sequentially crosses optical paths of the photo-couplers 11*h*. In this instance, each of the key sensors 11*b* is implemented by lower and upper photo-couplers, and the lower photo-coupler is closer to the key bed 10*d* than the upper photo-coupler. The shutter plate 11*g* sequentially interrupts the optical beam of the upper photo-coupler and the optical beam of the lower photo-coupler on the way from the rest position to the end position, and the optical path of the lower photo-coupler and the optical path of the upper photo-coupler are successively established through the upwardly motion of the shutter plate 11*g*. The shutter plate 11*g* is moved together with the associated key 10*b*, and, for this reason, the actual position of the shutter plate 11*g* is equivalent to the actual position of the key 10*b*. The key sensor 11*b* generates a key position signal KP1 indicative of the actual position of the key 10*b*. The shutter plate 11*g* allows the upper photo-coupler to pass through the slit pattern when the damper assembly 10*h* comes into contact with the set of strings 10*g* for absorbing the vibrations.

Each of the hammer sensors 11*c* is implemented by photo-couplers 11*i* and 11*j*. The photo-couplers 11*j* are closer to the strings 10*g* than the other photo-couplers 11*i*, and the photo-couplers 11*j* are regulated to rebounding points of the associated hammer assemblies 10*f* where the hammer shanks reach at the rebound of the hammer heads on the strings 10*g*. For this reason, an impact time ti or the rebound of the hammer assembly 10*f* on the strings 10*g* is detectable by the associated photo-coupler 11*j*. Each of the hammer sensors 11*c* produces a hammer position signal HP1 indicative of an actual position of the associated hammer assembly 10*f*.

The controller 11*d* is broken down into a recording sub-system 11*k* for producing music data codes indicative of an original performance on the key board 10*a*, a memory sub-system 11*m* for storing the music data codes, a data port 11*n* for communicating with the outside thereof and a playback sub-system 11*o* for controlling the solenoid-operated actuator units 11*a*. In this instance, each of the music data codes contains at least a first piece of data information indicative of a depressed/released key 10*b*, a second piece of data information indicative of a hammer velocity vH, a third piece of data information indicative of the impact time ti, a fourth piece of data information indicative of a released key velocity vkN and a fifth piece of data information indicative of a return time tkN. The fourth and fifth pieces of data information will be described hereinlater.

The recording sub-system 11*k* has a recording unit 11*p* for generating the first to fifth pieces of data information and a post-treatment unit 11*q* for normalizing the second to fifth pieces of data information. The acoustic piano has its individuality, and the individuality affects the second to the fifth pieces of data information. If an original performance is recorded by an automatic player piano, the music data codes contains the individuality. When the music data codes are supplied to another automatic player piano without the normalization, the automatic player piano can not faithfully reproduce the original performance due to the difference in the individuality between the automatic player pianos. In order to faithfully reproduce the original performance, is necessary to modify the second to fifth pieces of data information to a standard automatic player piano, and the modification is carried out through the normalization.

The recording unit 11*p* behaves in a recording mode as follows. Assuming now that a player depresses one of the keys 10*b* in an original performance, the depressed key 10*b* actuates the key action mechanism 10*e*. The actuated key action mechanism 10*e* rotates the associated hammer assembly 10*f*, and the hammer assembly 10*f* escapes from the jack of the key action mechanism 10*e* so as to start a free rotation toward the strings 10*g*.

The hammer assembly 10*f* firstly interrupts the optical-beam of the photo-coupler 11*i*, and, thereafter, interrupts the optical-beam of the photo-coupler 11*j*. The recording unit 11*p* periodically scans data input nodes respectively assigned to the hammer sensors 11*c* and the key sensors 11*b*, and can determine the depressed/released key 10*b*. The key code assigned to the depressed/released key 10*b* gives the first piece of data information.

When the recording unit 11*p* identifies the depressed key 10*b*, the recording unit 11*p* counts the time interval between the interruption of the photo-coupler 11*i* and the interruption of the photo-coupler 11*j*. The distance between the photo-couplers 11*i* and 11*j* is divided by the time interval, and determines the hammer velocity vH for the depressed key 10*b*. The hammer velocity vH serves as the second piece of data information.

When the hammer assembly 10*f* rebounds on the strings 10*g*, the set of strings 10*g* vibrates, and generates the acoustic piano sound. The hammer assembly 10*f* interrupts the optical-beam of the photo-coupler 11*j* at the impact of the hammer assembly 10*f* against the set of strings 10*g*, and the recording unit 11*p* determines the impact time ti. The impact time ti provides the third piece of data information.

The hammer assembly 10*f* turns in the opposite direction after the rebound, and is interrupted by the back check of the key action mechanism 10*e*.

When the player releases the key 10*b* at the end position, the key 10*b* returns from the end position toward the rest position, and the key action mechanism 10*e* allows the hammer assembly 10*f* to return to the home position. The shutter plate 11*g* successively causes the lower photo-coupler and the upper photo-coupler to establish the optical paths again. When the shutter plate 11*g* allows the lower photo-coupler of the key sensor 11*b* to sense the optical beam, the recording unit 11*p* starts to count time, and stops the counting at the photo-detection of the upper photo-coupler. The recording unit 11*p* determines a lapse of time between the first photo-detection of the lower photo-coupler and the second photo-detection of the upper photo-coupler, and calculates a released key velocity vkN by dividing the distance between the lower and upper photo-couplers by the lapse of time. The recording unit 11*p* further determines a return time tkN when the upper photo-coupler detects the optical beam. The released key velocity vkN and the return time tkN provides the fourth piece of data information and the fifth piece of data information.

The post-treatment unit 11*q* normalizes the second to fifth pieces of data information supplied from the recording unit 11*p*, and the first to fifth pieces of data information are coded into the music data codes. The normalization eliminates noise due to the individuality from the second to fifth pieces of data information. In detail, the hammer velocity vH, the impact time ti, the released key velocity vkN and the return time tkN are affected by differences between target positions of the key/hammer sensors 11*b*/11*c* and actual positions thereof and so forth. The post-treatment unit 11*q* stores parameters determined on the basis of these differences, and changes the second to fifth pieces of data information to those of a standard automatic player piano.

While the player is playing the acoustic piano 10, the recording unit 11*p* and the post-treatment unit 11*q* generate a set of music data codes indicative of the performance, and the set of music data codes are stored in the memory sub-system 11*m* such as a floppy disk system or transferred from the port 11*n* to an external musical instrument.

The playback sub-system 11*o* comprises a pretreatment unit 11*r*, a motion controller 11*s* and a servo controller 11*t*.

The pretreatment unit 11*r* generates preliminary control data indicative of a first trajectory of a depressed key and a second trajectory of a released key or first, second and composite trajectories for a half stroke as follows. These trajectories are represented by a series of position data (t, X). "X" represents a position on the trajectories at time "t".

The position data (t, X) is supplied from the pretreatment unit 11*o* to the motion controller 11*s*, and the motion controller 11*s* generates a position control data so as to move the key 10*b* to the position "X" at time "t". The position control data is supplied to the servo controller 11*t*, and the servo controller 11*t* supplies a driving current signal DR1 to the solenoid-operated key actuator 11*a*. The servo controller 11*t* compares the target position "X" with the actual position "X" represented by the feedback signal FB1, and varies the driving current signal DR1 so as to move the key 10*b* along the trajectory through the feed-back control.

Control Principle

Using the automatic player piano shown in FIG. 1, the present inventors measured the key velocity and the hammer velocity at the impact against the strings 10*g*, and noticed that the hammer velocity at the impact was explainable with a key velocity at a special point on the trajectory of a depressed key. Although the special point was variable not only between piano models but also between individual products of the same model, the special points ranged between 9.0 millimeters and 9.5 millimeters under the rest positions. Then, the present inventor concluded that, if a key was controlled so as to pass the special point at the key velocity equal to that of an original performance, the hammer would struck the strings at the impact equal to that in the original performance.

The special point is hereinbelow referred to "reference point Xr", and the key velocity at the reference point Xr is called as "reference velocity Vr".

Figure 2:
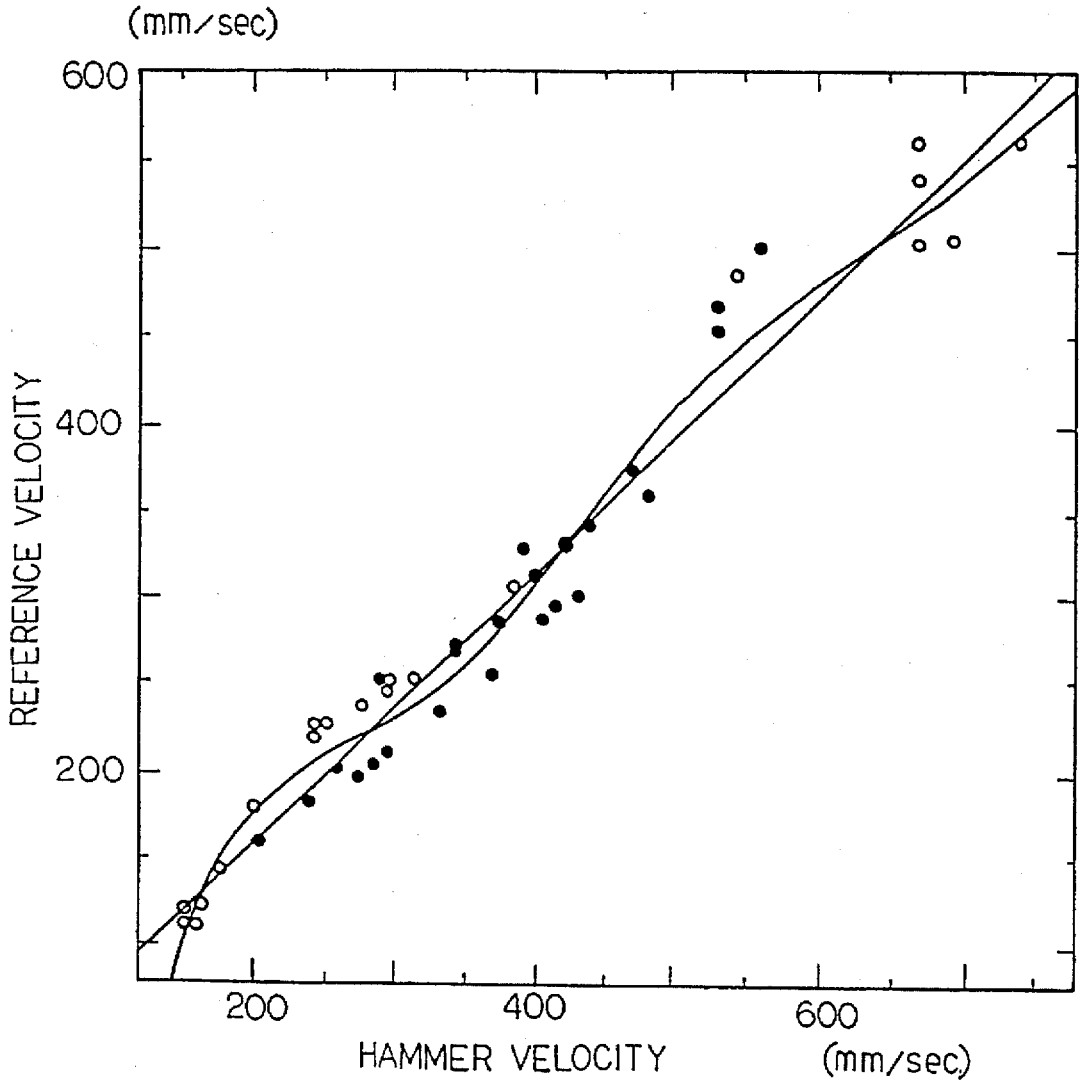
FIG. 2 is a graph showing a relation between a hammer velocity and a reference velocity.

The present inventors plotted the hammer velocity in terms of the reference velocity Vr in FIG. 2. The reference point Xr was set to 9.5 millimeters below the rest position. Bubbles stand for the hammer velocities when each key was simply depressed from the rest position to the end position. On the other hand, dots represent the hammer velocities measured in repetition where each key returned toward the rest position before reaching the end position.

C1 is indicative of the first-order least square approximation, and C2 is the sixth-order least square approximation. As will be understood, the relation between the reference velocity Vr and the hammer velocity at the impact is well approximated by using the linear line C1 and the non-linear line C2. In other words, the reference velocity Vr of a key is determined by using an impact data indicative of the hammer velocity. If the linear line C1 indicative of the first-order least square approximation is employed, the reference velocity Vr is calculated as follows.

$$Vr=alpha\times vH+beta \qquad \text{Equation 1}$$

where vH is the hammer velocity represented by the impact data and alpha and beta are constants. The constants alpha and beta are determined through experiments using an actual automatic player piano. The constants alpha and beta are variable depending upon the reference point Xr.

Subsequently, it is necessary for us to determine a reference time tr when a key passes the reference point Xr. Now, we define a reference time interval Tr as "a time interval between the reference time tr and the impact time ti". The photo-coupler 11*j* is positioned at the rebounding point, and the third piece of data information is representative of the impact time ti.

Figure 3:
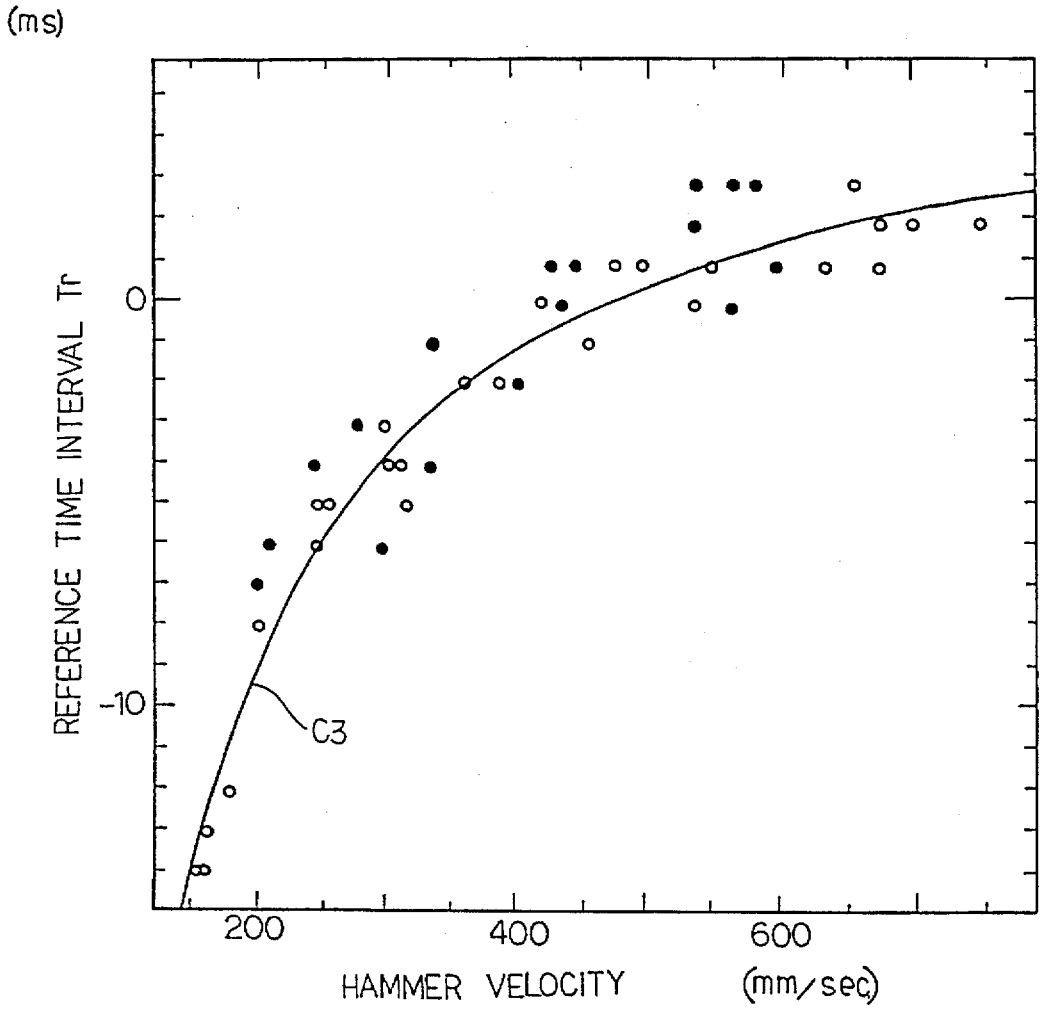
FIG. 3 is a graph showing a relation between a hammer velocity and a reference time interval.
Figure 4:
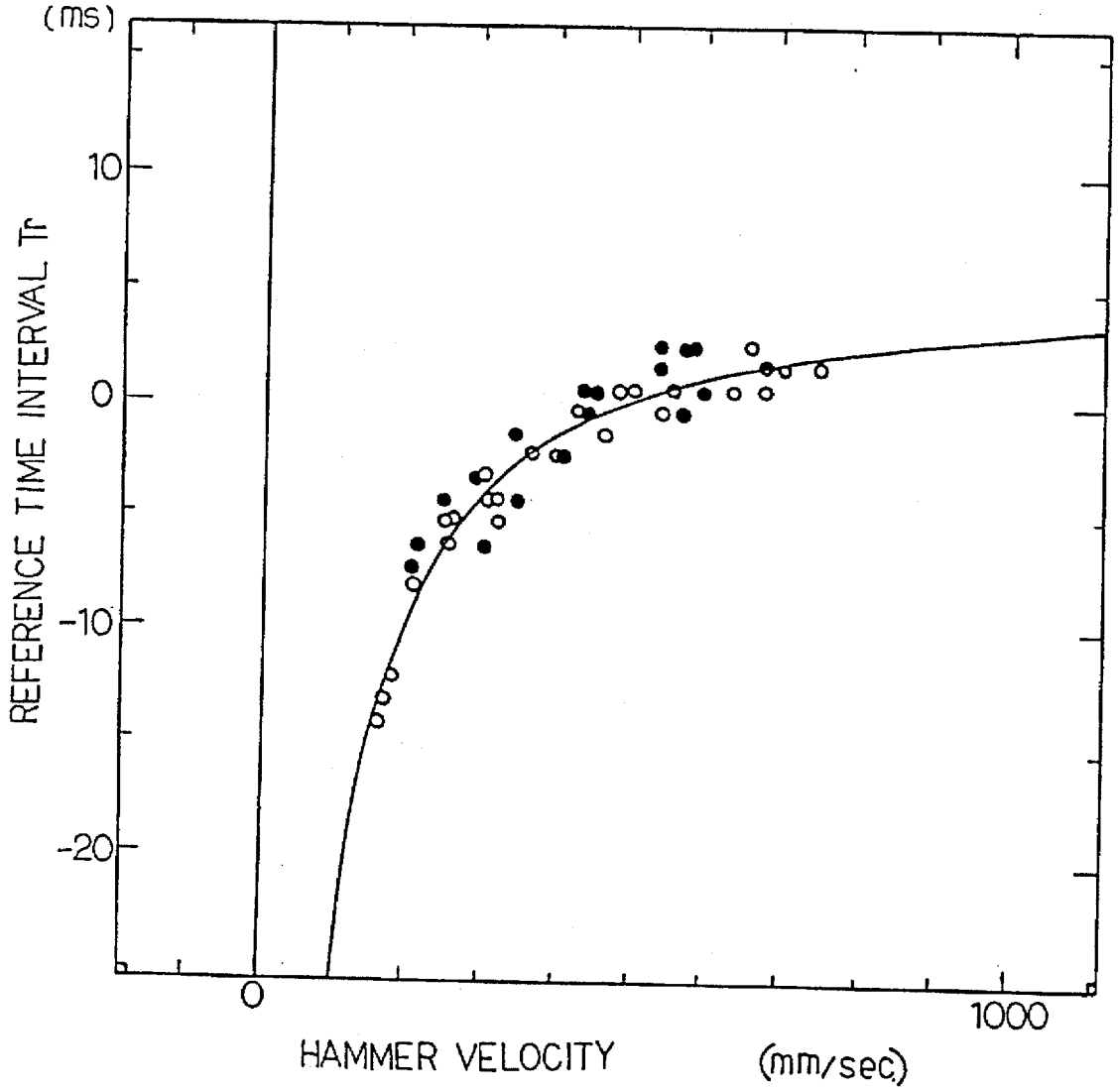
FIG. 4 is a graph showing the relation between the hammer velocity and the reference time interval at 200 percent.
Figure 5:
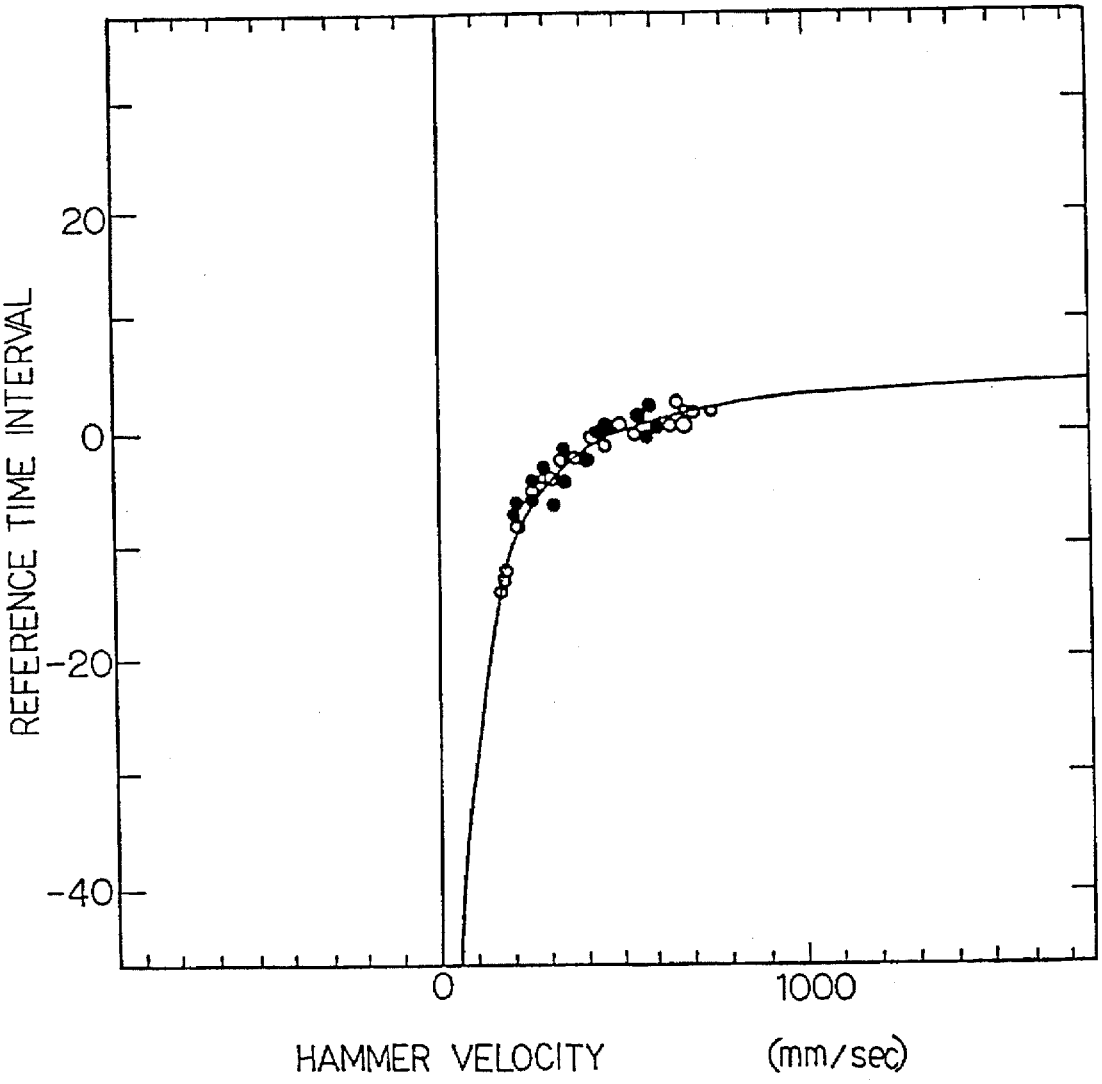
FIG. 5 is a graph showing the relation between the hammer velocity and the reference time interval at 400 percent.

The present inventors plotted the reference time interval Tr in terms of the hammer velocity in FIG. 3. Bubbles stands for the reference time intervals Tr in the simple key motion, and dots represents the reference time intervals Tr in the repetition as similar to FIG. 2. The relation between the reference time interval Tr and the hammer velocity is scaled up at 200 percent in FIG. 4, and at 400 percent in FIG. 5. The reference time intervals Tr are approximated by a hyperbolic line C3, and is expressed as Equation 2.

$$Tr=-(gamma/vH)+delta \qquad \text{Equation 2}$$

where gamma and delta are constants. Gamma and delta are determined through experiments. Constants gamma and delta are variable depending upon the model and further upon the reference point Xr as similar to alpha and beta.

If the reference time interval Tr is calculated by using equation 2, the reference time tr is given by subtracting the reference time interval Tr from the impact time ti on the absolute time scale from the starting time. If the key 1 is controlled in such a manner as to pass the reference point Xr at the reference time tr at the reference velocity Vr, the original tone is faithfully reproduced.

If the hammer 10*f* strikes the strings 10*g* at the reference point Xr, the reference time interval Tr is useless.

Figure 6:
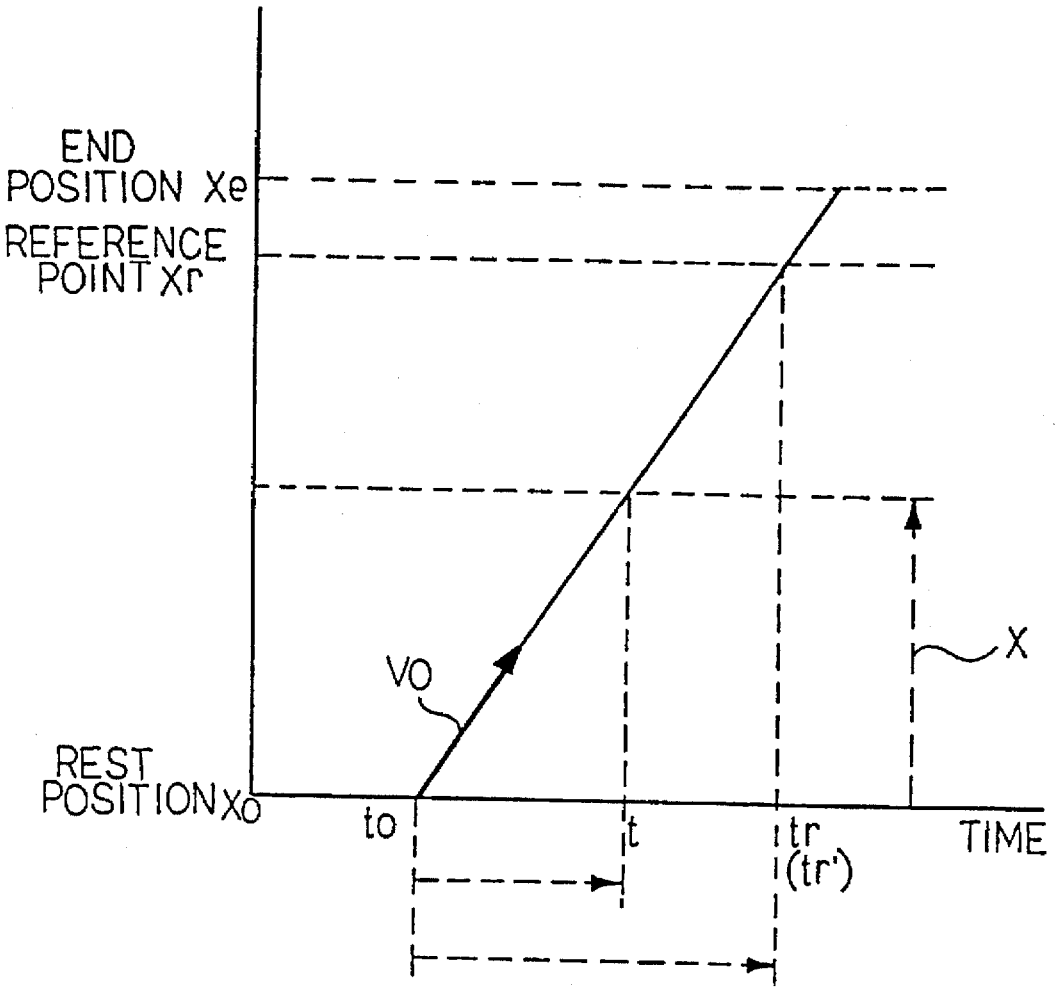
FIG. 6 is a graph showing a uniform key motion from a rest position to an end position in terms of time.

As described hereinbefore, the pretreatment unit 11*r* generates preliminary control data indicative of a first trajectory of a depressed key and a second trajectory of the released key as follows. In this instance, the key 10*b* is assumed to take a uniform motion between the rest position Xo to the end position Xe, and FIG. 6 illustrates the first trajectory. If the key 10*b* starts the uniform motion from the rest position Xo at time t0, the key 10*b* is moved toward the end position Xe at a constant speed V0. The key 10*b* is moved over distance X, and reach key position X at time t. The distance X is expressed by equation 3.

$$X=V0\times t+X0 \qquad \text{Equation 3}$$

The reference point Xr is given as $$Xr=V0\times tr'+X0 \qquad \text{Equation 4}$$

where tr'is a reference time when the key 10*b* reaches the reference point Xr. Solving Equation 4 for the reference time tr', the reference time tr' is expressed as $$tr'=(Xr-X0)/V0 \qquad \text{Equation 4'}$$

A starting time t0 of the depressed key 10*b* on the absolute time scale is given by Equation 5.

$$t0=tr-tr'=tr-(Xr-X0)/V0 \qquad \text{Equation 5}$$

The reference time tr is equal to the difference between the impact time ti and the reference time interval Tr as described hereinbefore.

Therefore, if the plunger 11*e* of the solenoid-operated actuator unit 11*a* starts to upwardly push the associated key 10*b* at time t0 and moves the key 10*b* over the distance X along the first trajectory expressed by equation 3, the key 10*b* reaches the reference point Xr at the reference time tr, and the key velocity at the reference point Xr is equal to the reference velocity Vr.

In this instance, the key 10*b* is assumed to take the uniform motion. The uniform motion makes the reference velocity Vr equal to the constant key velocity V0. The music data code gives the hammer velocity vH to the pretreatment unit 11*r*, and the reference velocity Vr is calculated by using Equation 1. Equation 5 gives the time t0 to the pretreatment unit 11*r*. Therefore, the pretreatment unit 11*r* produces the preliminary control data representative of a key motion continued at the constant velocity Vr from the rest position at time t0 to the end position.

The preliminary control data produced by the pretreatment unit 11*r* are further used for controlling a backward motion after release of the depressed key 10*b* as follows.

Figure 7:
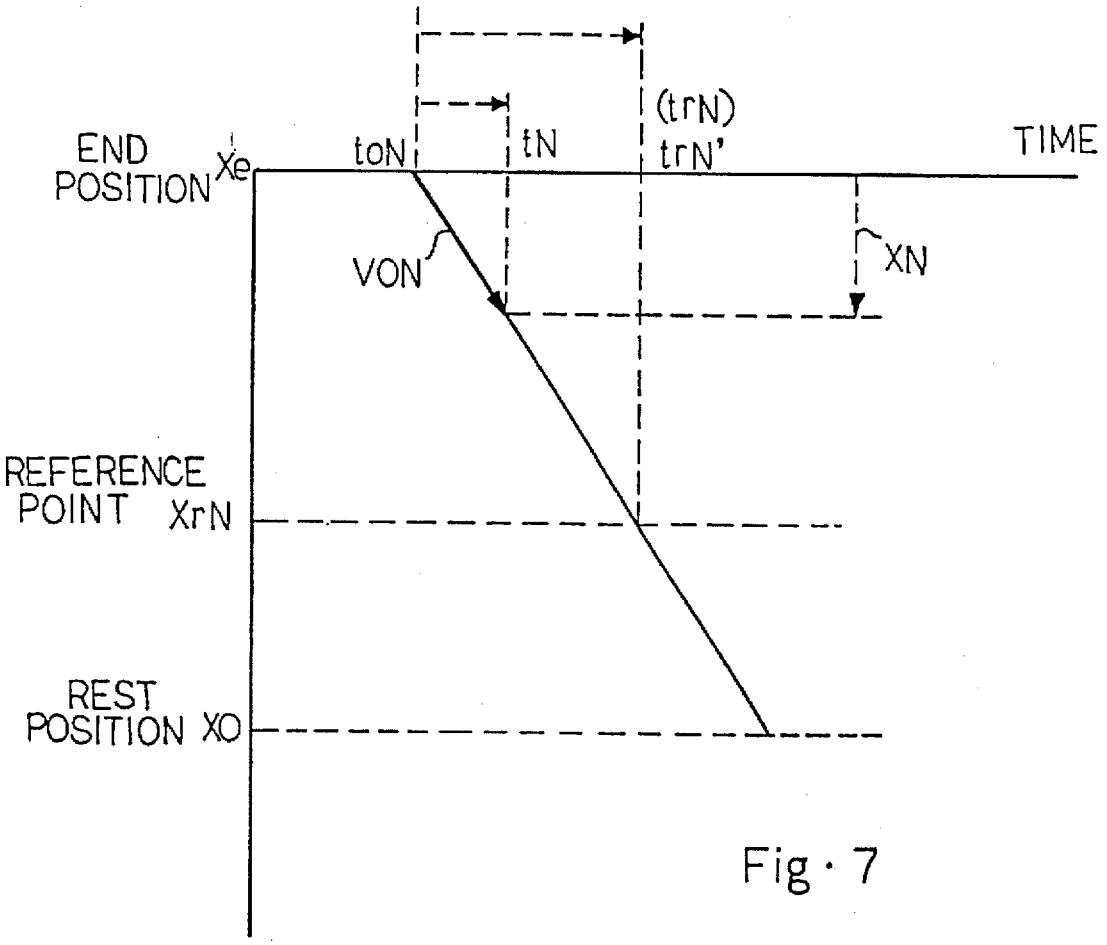
FIG. 7 is a graph showing a uniform key motion from the end position to the rest position in terms of time.

A key position XN at a time tN is expressed by equation 6.

$$XN=V0N\times tN+Xe \qquad \text{Equation 6}$$

where V0N is the initial key velocity (<0) at the end position Xe. The second trajectory represented by equation 6 is illustrated in FIG. 7 of the drawings.

As described hereinbefore, the damper assembly 10*h* comes into contact with the associated set of strings 10*g* at a return time tkN, and the damper assembly 10*h* starts the absorption of the vibrations on the strings 10*g*. The return time tkN is detectable with the upper photo-coupler of the associated key sensor 11*b*. The fourth and fifth pieces of data information are representative of the released key velocity vkN and the return time tkN, respectively.

Let us assume that the damper assembly 10*h* comes into contact with the strings 10*g* at a key position on the second trajectory defined as "released reference point XrN". If the playback sub-system 11*o* controls the released key 10*b* in such a manner as to reach the released reference point XrN at the return time tkN, the decay of the piano sound in the playback is approximated to that of the original piano sound.

It is desirable to exactly control the damper velocity at the contact with the strings 10*g*, because it strongly affects the decay of the tone. The damper velocity is dominated by the key velocity. For this reason, if the key velocity at the released reference point XrN is adjusted to the released key velocity vkN, the decay of the original piano sound is exactly reproduced in the playback. The key velocity at the released reference point XrN is referred to as "released reference velocity VrN.

If a key 10*b* is released at time zero, the released reference point XrN is expressed as $$XrN=V0N\times trN'+XeN \qquad \text{Equation 7}$$

where trN' is a time when the released key 10*b* reaches the reference point XrN. V0N are equal to VrN and VkN, because the key 10*b* takes the uniform motion. It is possible to determine trN' from equation 7, and the starting time t0N is given by equation 8.

$$t0N=trN-trN'=trN-(XrN-XeN)/V0N \qquad \text{Equation 8}$$

The playback sub-system 11*o* causes the solenoid-operated key actuator 11*a* to move the released key 10*b* from the starting time t0 along the second trajectory expressed by equation 6. Then, the released key 10*b* passes the released reference point XrN at the return time tkN. In this instance, the initial key velocity V0N is equal to the reference key velocity vkN, and the reference key velocity vkN is equal to the released reference velocity VrN. If the key is controlled in such a manner as to start with the initial key velocity equal to the released key velocity vkN at time t0, the key 10*b* similarly behaves.

Figure 8A:
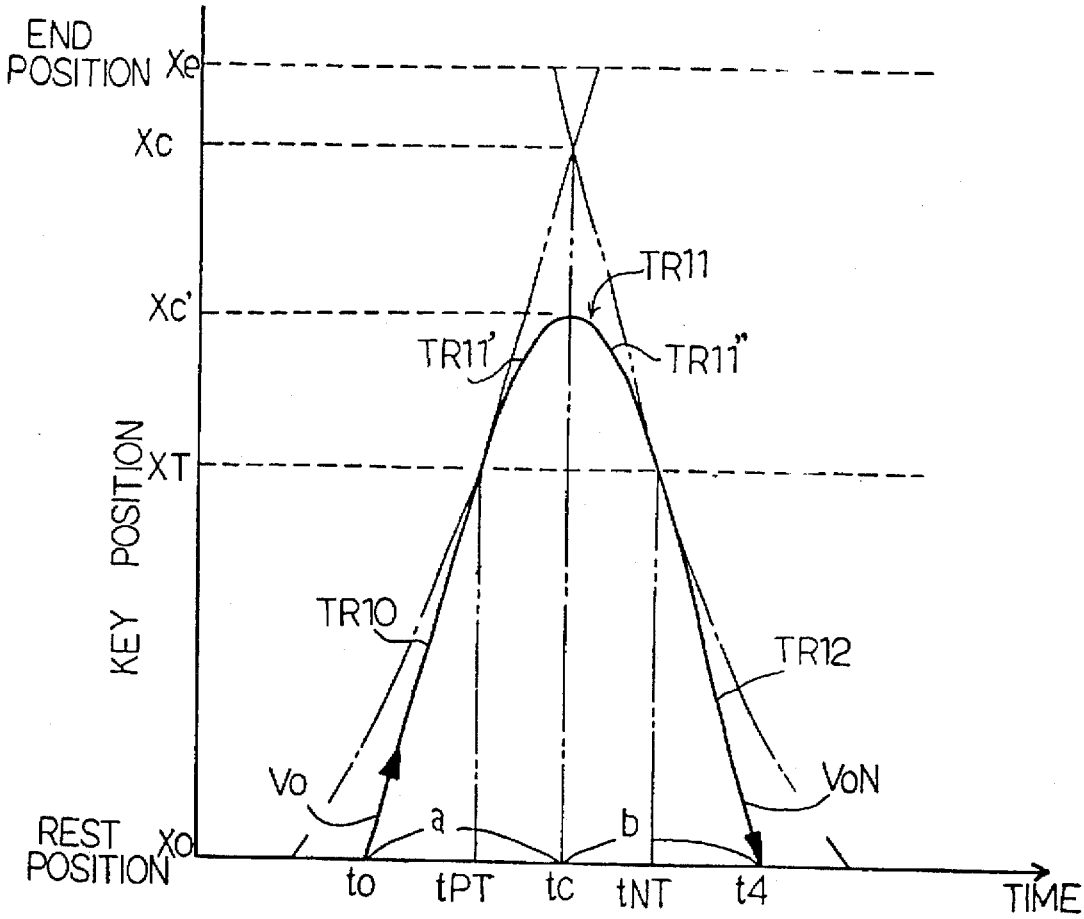
FIG. 8A is a graph showing a composite trajectory in a half stroke.
Figure 8B:
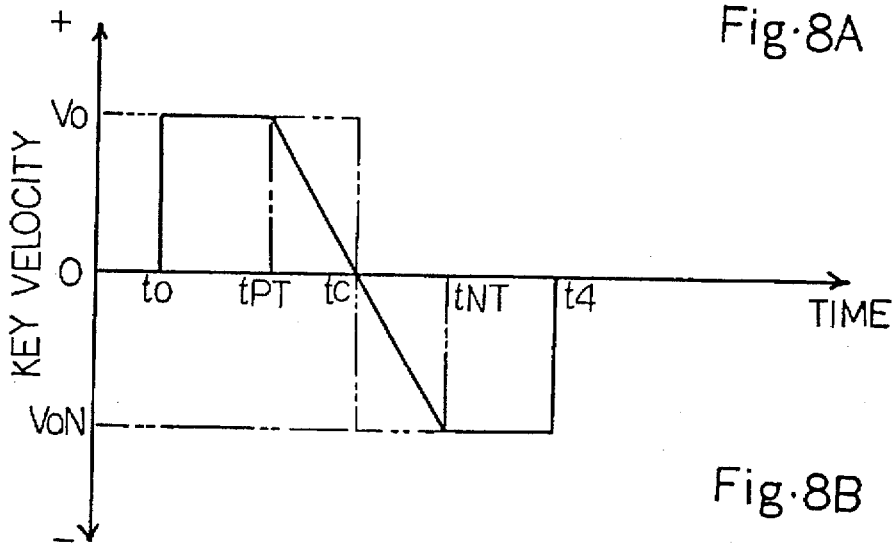
FIG. 8B is a graph showing a key velocity in the half stroke in terms of time.

Subsequently, description is made on a composite trajectory for a half stroke. When a key **10*b* is simply depressed from the rest position to the end position or released from the end position to the rest position, the key 10*b* is moved along the first trajectory and the second trajectory representative of the uniform motion. If a player releases the key 10*b* at a certain point on the first linear trajectory, the half stroke is approximated to a composite trajectory shown in FIG. 8A. The key 10*b* takes the uniform motion along a first linear trajectory TR10 until a transit point XT, and changes the direction along a transitional trajectory TR11, then taking a second linear trajectory TR12 from the transit point XT to the rest position Xo. The transitional trajectory TR11 is broken down into a decelerating trajectory TR11' and an acceleration trajectory TR11", and the deceleration trajectory TR11' and the acceleration trajectory TR11"** are quadratic curves.

The key **10*b* starts at time t0, and reaches the transit point XT at time tPT. The key 10*b* turns at point Xc', and restarts the uniform motion from the transit point XT at time tNT. The key 10*b* returns to the rest position Xo at time t4**. The transit point XT is closer to the end position Xe than the mid point between the rest position Xo and the end position Xe.

The composite trajectory is determined as follows. First, the first linear trajectory is assumed to cross the second linear trajectory at a crossing point Xc. If the key **10*b* is simply depressed and released, the key 10*b* reaches the crossing point Xc at time tc. The time tc is determined on the basis of the data representative of the first linear trajectory TR10 and the second linear trajectory TR12. The velocity of the key 10*b* is zero at time tc, and the decelerating trajectory TR11' and the acceleration trajectory TR11" are led from following boundary conditions. While the key 10*b* is traveling from the transit point XT to a turning point Xc', the key velocity is decreased from an initial key velocity Vo to zero, and the deceleration consumes a time period from time tPT to time tc. On the other hand, while the key 10*b*** is being accelerated from time tc to time tNT, the key velocity is increased from zero to VoN.

First, the time tc is calculated as follows. The key **10*b* consumes a time a from the rest position Xo at time t0 to the turning point Xc' at time tc and a time b from the turning point Xc' to the rest position Xo at time t4**. Then, the relation between the key velocity and the time period is expressed by equation 9.

$$Vo \times a = -VoN \times b \qquad \text{Equation 9}$$

The time periods a and b satisfy equation 10.

$$a+b=t4-t0 \qquad \text{Equation 10}$$

From equation 9 and 10, the time period a is given by equation 11.

$$a=VoN(t4-t0)/(VoN-Vo) \qquad \text{Equation 11}$$

The time tc is expressed by equation 12.

$$\begin{aligned} tc &= t0+a \\ &= t0+VoN(t4-t0)/(VoN-Vo) \\ &= (VoN \times t4 - Vo \times t0)/(VoN-Vo) \end{aligned} \qquad \text{Equation 12}$$

The time t4 is expressed as $$t4=ton-(Xe-Xo)/VoN \qquad \text{Equation 13}$$

Acceleration aP between time tPT and time tc is calculated as follows.

$$aP=-Vo/(tc-tPT) \qquad \text{Equation 14}$$

The time tPT is given by equation 15.

$$tPT=t0+(XT-Xo)/Vo \qquad \text{Equation 15}$$

The acceleration aP has a negative value, and the key velocity on the decelerating trajectory TR11' is expressed by equation 16.

$$V=Vo+aP(t-tPT) \qquad \text{Equation 16}$$

An arbitrary key position X on the decelerating trajectory TR11' is expressed by equation 17.

$$X=P1\ t^2+Q1\ t+R1 \qquad \text{Equation 17}$$

where P1, Q1 and R1 are constants and t is a time on the absolute time scale. The constants P1, Q1 and R1 are determined by substituting values on the absolute time scale shown in FIG. 8A for t of equation 17 and a derivative of equation 17. The quadratic function expressed by equation 17 has the gradients Vo at time tPT and zero at time tc, and has value XT at time tPT. When substituting these values for time t, we obtain the constants P1, Q1 and R1.

The acceleration aN on the accelerating trajectory TR11" is calculated as follows. The acceleration aN is given by equation 18.

$$aN=VoN/(tNT-tc) \qquad \text{Equation 18}$$

The time tNT is given by equation 19.

$$tNT=t4+(XT-Xo)/VoN \qquad \text{Equation 19}$$

Equation 20 gives the key velocity V on the accelerating trajectory TR11", and equation 21 expresses an arbitrary key position XN on the accelerating trajectory TR11".

$$V=aN(t-tc) \qquad \text{Equation 20}$$

$$XN=P2\ t^2+Q2\ t+R2 \qquad \text{Equation 21}$$

where R2, Q2 and R2 are constants. Substituting specific values on the absolute time scale shown in FIG. 8A for t of equation 21 and a derivative of equation 21, we obtain the constants R2, Q2 and R2. Equation 21 expresses a quadratic function having gradients VoN at time tNT and zero at time tc, and has value XT at time tNT. The maximum value of equation 21 is equal to the maximum value of equation 17, and the quadratic function expressed by equation 21 is connected to the quadratic function expressed by equation 17 at time tc. The turning point Xc' is the junction between these quadratic functions.

The half stroke is discriminative as follows. If the key **10*b* is moved along the composite trajectory shown in FIG. 8A, the junctions Xc and Xc' are located between the transit point XT and the end position Xe. If a player repeats the key 10*b* in the vicinity of the end position Xe, a first linear trajectory TR13 does not cross a second linear trajectory TR14 between the rest position Xo and the end position Xe (see FIGS. 9A and 9B), and only a decelerating trajectory TR15' is connected to an accelerating trajectory TR15" before the end position Xe. However, when a player simply depresses the key 10*b*** at the rest position Xo and releases it at the end position Xe, not only the first linear trajectory but also the decelerating trajectory are never connected to the second linear trajectory and the accelerating trajectory, respectively.

Thus, the half stroke is discriminated by comparing the turning point Xc' with the end position Xe. Even if the crossing point Xc exceeds over the end position Xe, the composite trajectories TR15'/TR15" are determined in so far as the turning point Xc' fall within the range between the rest position Xo and the end position Xe. When both of the crossing point Xc and the turning point Xc' exceed over the end position Xe, the pretreatment unit 11r assumes that a player simply depresses the key at the rest position Xo, and releases it at the end position Xe, the key 10b is moved on the first trajectory shown in FIG. 6 and the second trajectories shown in FIG. 7, and the pretreatment unit 11r does not calculate a decelerating trajectory and an accelerating trajectory.

The pretreatment unit 11r determines whether or not the first linear trajectory crosses the second linear trajectory as follows. There are three conditions to determine that a first linear trajectory crosses a second linear trajectory. If one of the three conditions is satisfied, the pretreatment unit 11r determines that the first linear trajectory crosses the second linear trajectory.

First, the pretreatment unit 11r calculates the crossing point Xc by using equation 22.

$$Xc=Xo+(t4-t0)\times Vo\times VoN/(VoN-Vo) \quad \text{Equation 22}$$

The second term of the right side represents the distance from the rest position Xo to the crossing point Xc, and the distance is calculated by using equations 9 to 11. The pretreatment unit 11r simply compares the crossing point Xc with the end position Xe.

Figure 9A:
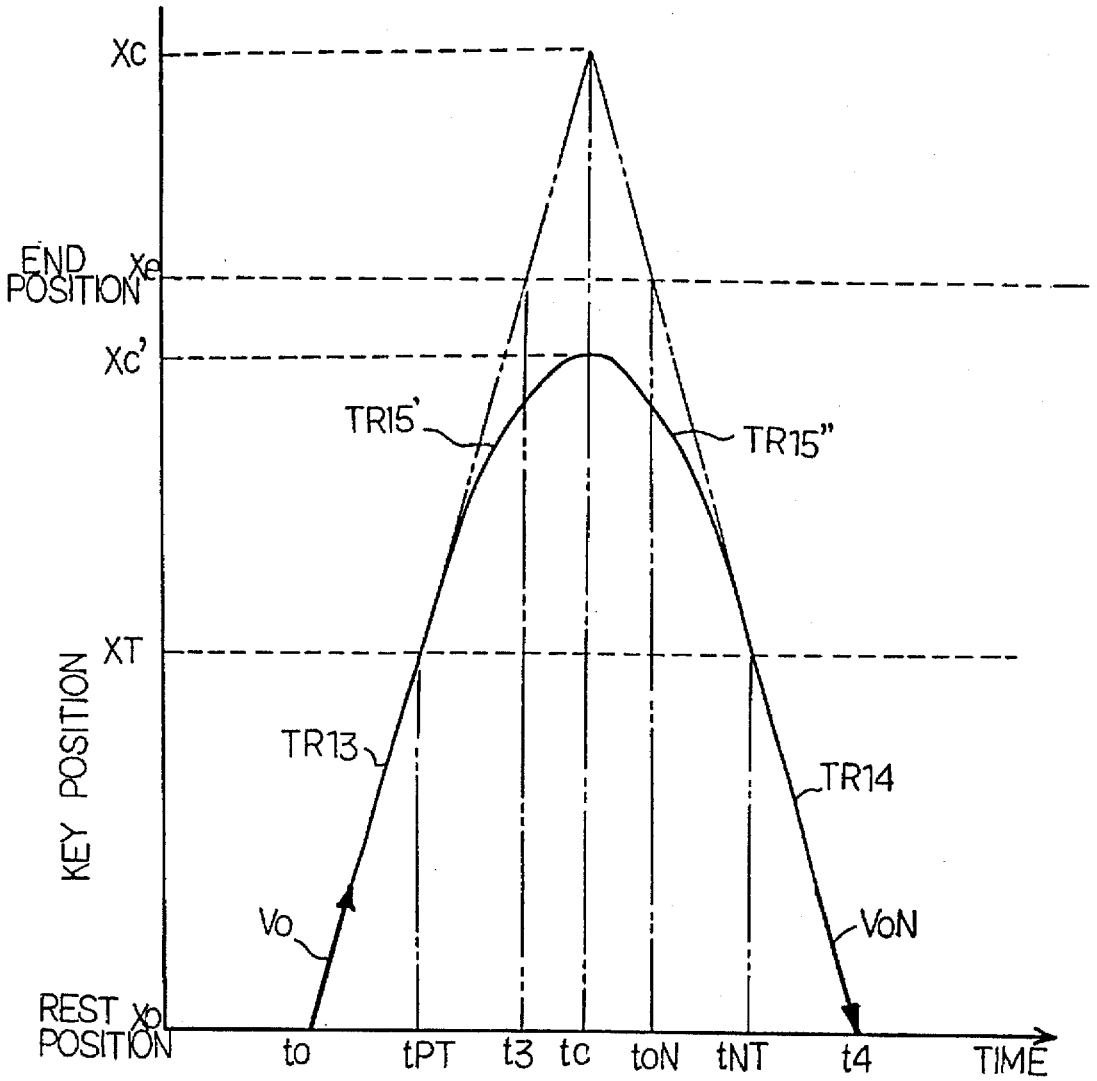
FIG. 9A is a graph showing a composite trajectory in a half stroke in the vicinity of the end position.
Figure 9B:
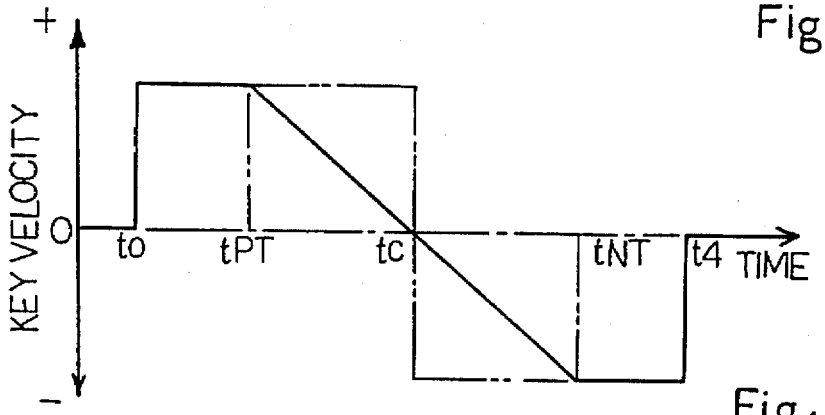
FIG. 9B is a graph showing a key velocity in the half stroke in terms of time.

Second, a depressed key is assumed to reach the end position Xe at time t3 and to restart from the end position Xe at time ton (see FIG. 9A). The time t3 is compared with the time toN. If the time t3 is later than the time toN, the pretreatment unit 11r decides that the first linear trajectory crosses the second linear trajectory, and, accordingly, calculates the composite trajectory.

Third, the time tc is compared with the time t3. If the time tc is earlier than the time t3, the pretreatment unit 11r decides that the first linear trajectory crosses the second linear trajectory. If the time ton is earlier than the time tc, the pretreatment unit 11r similarly decides that the first linear trajectory crosses the second linear trajectory.

If first and second trajectories do not satisfy these three conditions, the pretreatment unit 11r determines whether or not a decelerating trajectory crosses an accelerating trajectory as follows. The first approach is to calculate the turning point Xc'. The turning point Xc' takes place at the mid point between the crossing point Xc and the transit point XT, and is given by equation 23.

$$Xc'=XT+(Xc-XT)/2=(Xc+XT)/2 \quad \text{Equation 23}$$

if the turning point Xc' is less than the end position Xe, the pretreatment unit 11r decides that the decelerating trajectory crosses the accelerating trajectory.

The second approach is delivered from the following boundary conditions. When both key velocities on the decelerating trajectory and the accelerating trajectory are zero at the end position Xe, the turning point Xc' is matched with the end position Xe, and the boundary conditions are represented by the quadratic curve having a gradient of zero at the end position Xe. If the key 10b is moved along a composite trajectory TR17 shown in figure 10A, the key motion is not a half stroke. The key velocity on the decelerating trajectory TR17' reaches zero at time tPE', and the key velocity on the accelerating trajectory TR17" is increased from zero at time tNE'(see FIG. 10B). The composite trajectory TR17 does match the time tPE' with the time tNE', and the pretreatment unit 11r decides the key motion represented by the composite trajectory TR17 to be the non-half stroke. However, if time tPE' is greater than time tNE', the decelerating trajectory is integrated with the accelerating trajectory, and the composite trajectory is representative of a half stroke. Thus, the boundary conditions are whether or not time tPE' is greater than time tNE', and the pretreatment unit 11r decides a key motion whether to be a half stroke or not on the basis of the criterion, i.e., tNE'<tPE'.

The times tPE' and tNE' are calculated as follows.

$$tPE'=tPE+(Xe-XT)/Vo \quad \text{Equation 24}$$

$$tNE'=tNE+(Xe-XT)/VoN \quad \text{Equation 25}$$

The third approach is to compare time tc with time tPE' or tNE'. If the time tPE' is greater than the time tc, the decelerating trajectory is integrated with the accelerating trajectory. When the time tNE' is less than the time tc, the decelerating trajectory is also integrated with the accelerating trajectory.

Thus, the pretreatment unit 11r firstly decides whether or not a key motion is a half stroke. If the key motion is a half stroke, the pretreatment unit 11r determines a composite trajectory, and generates the preliminary control data representing the composite trajectory.

Behavior of Automatic Player Piano

The automatic player piano behaves in the recording mode as follows. While a player is selectively depressing the keys 10b, the depressed keys respectively exert forces on the associated key action mechanisms 10e, and the cause the key action mechanisms 10e to rotate the hammer assemblies 10f. The motion of each hammer assembly 10f is monitored by the associated hammer sensor 11c, and the hammer sensor 11c changes the hammer position signal HP upon the photo-intersection of the hammer shank at the photo-couplers 11i and 11j.

The recording unit 11p firstly determines the depressed key 10b, and calculates the hammer velocity vH on the basis of the time interval between the two photo-intersections. The recording unit 11p further determines the impact time ti at the second photo-intersection. The key code assigned to the depressed key, the hammer velocity vH and the impact time ti give the first, second and third pieces of data information. The first to third pieces of data information are normalized by the post-treatment unit 11q, and are coded into a music data code.

Each of the depressed key 10b returns toward the rest position upon release of the key, and the key motion is monitored by the key sensor 11b. The key sensor 11b changes the key position signal KP at the photo-interruptions of the shutter plate 11g, and the recording unit 11p firstly determines the released key 10b. The recording unit 11p calculates the released key velocity vkN, and determines the return time tkN. The key code assigned to the released key 10b, the released key velocity vkN and the return time tkN give the first, fourth and fifth pieces of data information. The first, fourth and fifth pieces of data information are normalized by the post-treatment unit 11q, and are coded into another music data code.

While the player is performing on the keyboard 10a, the recording unit 11p and the post-treatment unit 11q generate a series of music data codes representative of the original performance, and the series of music data codes are stored in the memory sub-system 11m. The series of music data codes may be supplied to another music instrument through the data port 11n.

When the automatic player piano is requested to reproduce the original performance, the series of music data codes are sequentially supplied to the playback sub-system 11*o*. Then, the pretreatment unit 11*r* starts a program sequence shown in FIG. 11. The music data codes are arranged in order of time, and the pretreatment unit 11*r* fetches the first music data code as by step SP1.

The pretreatment unit 11*r* checks the music data code to see whether or not the music data code represents a depressed key 10*b* as by step SP2. If the answer is given negative, the pretreatment unit 11*r* returns to step SP1, and fetches the next music data code. The pretreatment unit 11*r* repeats the loop consisting of steps SP1 and SP2 until the answer at step SP2 is changed to affirmative.

If the music data code contains the first to third pieces of data information, the answer at step SP2 is given affirmative, and the pretreatment unit 11*r* determines the first linear trajectory expressed by equation 3 for the depressed key 10*b* as by step SP3.

Subsequently, the pretreatment unit checks the other music data codes already received to see whether or not a music data code for the same key to be released is contained as by step SP4. The pretreatment unit 11*r* is expected to generate the preliminary control data representative of a trajectory from the rest position to the end position within a predetermined time, and the predetermined time is 0.5 second in this instance. If the music data code for the release has not arrived at the pretreatment unit 11*r* upon completion of the first linear trajectory, it is impossible to determine the decelerating trajectory and the accelerating trajectory. For this reason, the pretreatment unit 11*r* checks the music data codes to see whether or not the music data code for the release has already received.

If the answer at step SP4 is given affirmative, the pretreatment unit 11*r* proceeds to step SP5, and determines a second linear trajectory for the released key 10*b*. Subsequently, the pretreatment unit 11*r* tries to determine a composite trajectory as by step SP6.

Figure 12:
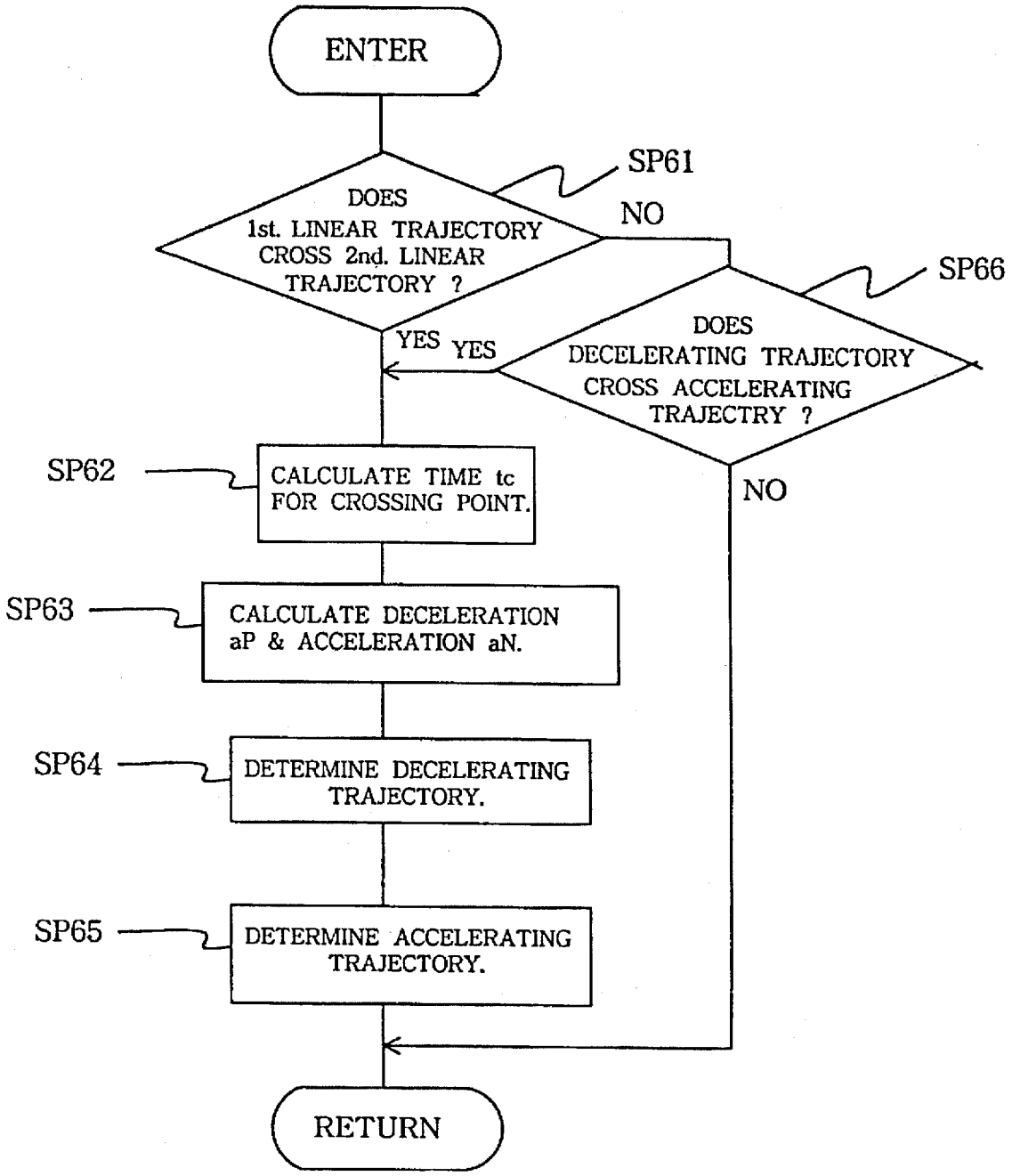
FIG. 12 is a flow chart showing a program sequence for determining trajectories of a key.

FIG. 12 details step SP6. First, the pretreatment unit 11*r* confirms whether or not the first linear trajectory crosses the second linear trajectory as by step SP61. If the music data codes represent a half stroke, the first linear trajectory crosses the second linear trajectory, and the answer at step SP61 is given affirmative. Then, the pretreatment unit 11*r* proceeds to step SP62, and calculates the time tc for the crossing point Xc by using equation 12.

Subsequently, the pretreatment unit 11*r* calculate the acceleration aP and the acceleration aN by using equations 14 and 18 as by step 63, and determines a decelerating trajectory and an accelerating trajectory through steps 64 and 65. Thereafter the pretreatment unit 11*r* returns to the program routine shown in FIG. 11.

On the other hand, if the first linear trajectory does not cross the second linear trajectory, the answer at step SP61 is given negative, and the pretreatment unit 11*r* confirms whether or not a decelerating trajectory crosses an accelerating trajectory as by step SP66. If the decelerating trajectory crosses the accelerating trajectory, the music data codes represent a half stroke near the end position Xe, and the pretreatment unit 11*r* is branched to step SP62. The pretreatment unit 11*r* determines the decelerating trajectory and the accelerating trajectory through steps SP62 to SP65, and returns to the program routine shown in FIG. 11.

Figure 11:
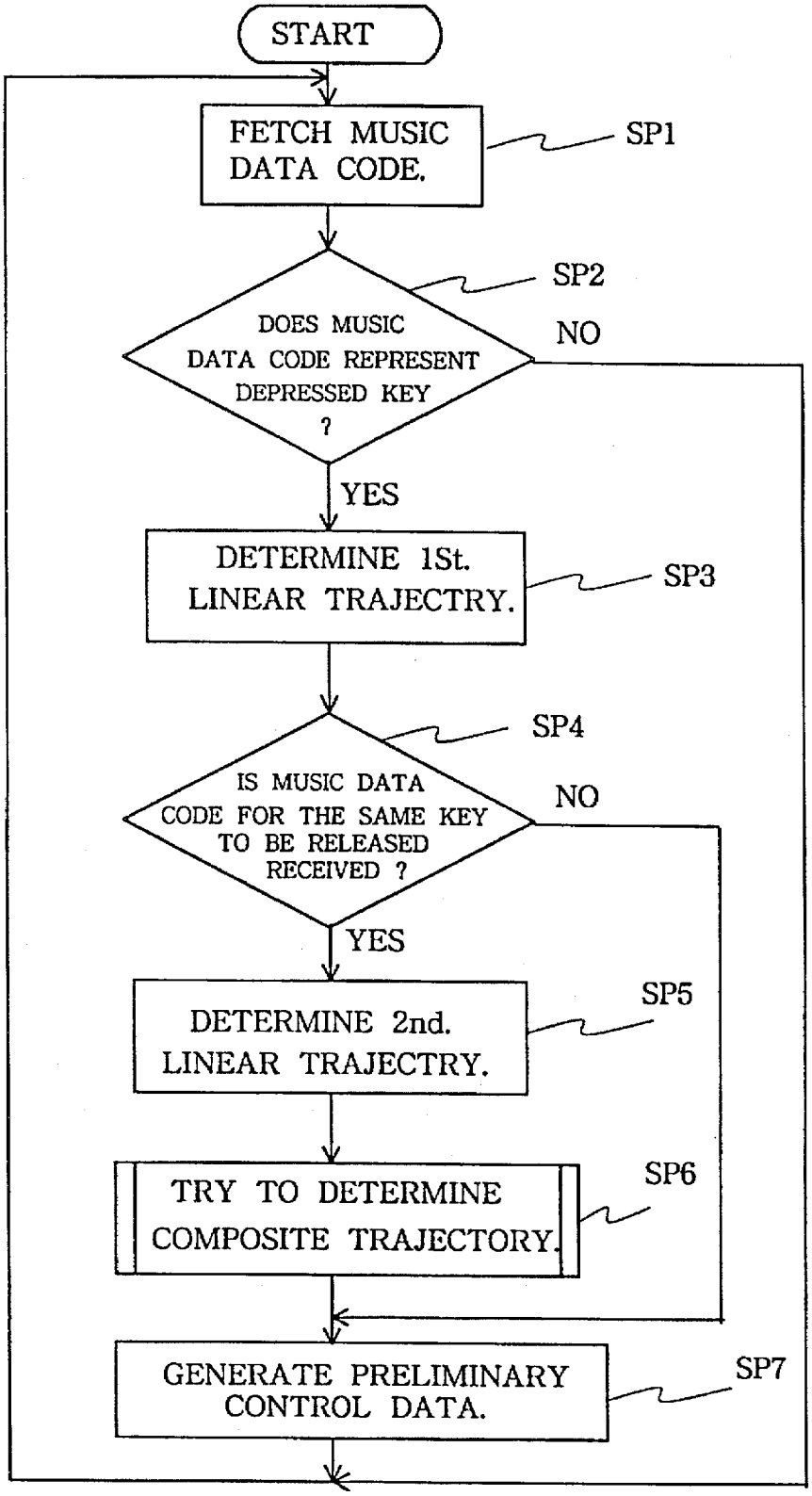
FIG. 11 is a flow chart showing a program sequence executed by a pretreatment unit for producing.

On the other hand, if the decelerating trajectory does not cross the accelerating trajectory, the answer at step SP66 is given negative, and the pretreatment unit 11*r* immediately returns to the program routine shown in FIG. 11.

When the pretreatment unit 11*r* returns to the program routine shown in FIG. 11, the pretreatment unit 11*r* proceeds to step SP7, and generates the preliminary control data for the half stroke key. As described hereinbefore, the preliminary control data is representative of a series of positional data (t, X), and "t" is increased from time t0 to time t4 at a constant pitch. However, time t may be increased at a short pitch along the decelerating/accelerating trajectories and at a long pitch along the first and second linear trajectories. Such a variable pitch decreases the amount of calculation, and allows the solenoid-operated key actuator 11 a to smoothly change the key motion between the first/second linear trajectories and the decelerating/accelerating trajectories.

Time t is substituted for equations 3, 17, 21 and 6 so as to determine the key position "X" Equation 3 is used for the key position "X" between time t0 and time tPT, and time t is substituted for equation 17 between time tPT and time tc. Equation 21 is available for the key position "X" between time tc and time tNT, and the pretreatment unit 11*r* uses equation 6 for the key position "X" between time tNT and time t4. The preliminary control data are supplied to a memory incorporated in the pretreatment unit 11*r*, and are stored therein in order of time.

If the pretreatment unit 11*r* does not find the music data code for the release, the answer at step SP4 is given negative, and the pretreatment unit 11*r* generates the preliminary control data representative of the first linear trajectory for the depressed key.

Thus, the pretreatment unit 11*r* reiterates the loop consisting of steps SP1 to SP7 until the pretreatment unit 11*r* treats all of the music data codes.

Figure 13:
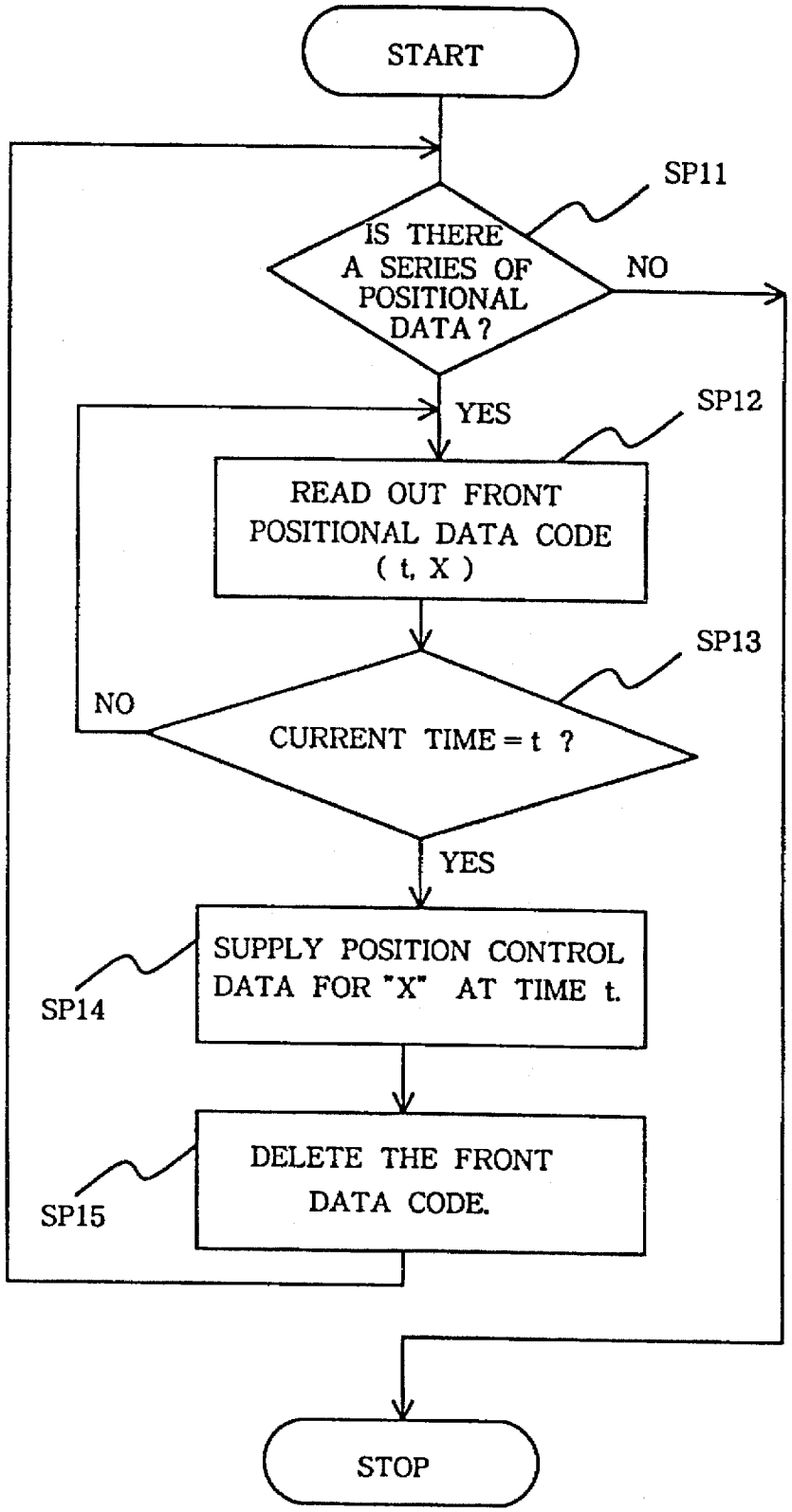
FIG. 13 is a flow chart showing a program sequence executed by a motion controller.

The preliminary control data are supplied to the motion controller 11*s*, and the motion controller 11*s* processes the preliminary control data through a program sequence shown in FIG. 13.

First, the motion controller 11*s* checks the memory of the pretreatment unit 11*r* to see whether or not the preliminary control data or a series of positional control data (t, X) has been already written therein as by step SP11. As described hereinbefore, the preliminary treatment unit 11*r* sequentially processes the music data codes, and writes the preliminary control data in the memory. Therefore, the answer at step SP11 is given affirmative until completion of the playback.

With the positive answer at step SP11, the motion controller 11*s* proceeds to step SP12 so as to read out the front positional data code (t0, X) of a series of positional data (t, X). Subsequently, the motion controller 11*s* compares the time t0 with current time on the absolute time scale as by step SP13. If the answer at step SP13 is given negative, the motion controller 11*s* reads out another front position data code (t0, X), if any, and compares the time t0 with the current time. Thus, the motion controller 11*s* reiterates the loop consisting of steps SP12 and SP13 until the current time is matched with the time t0 of any front positional data code.

When the current time reaches the time t0, the answer at step SP13 is changed to the positive answer, and the motion controller 11*s* supplies the positional control data representative of the target key position "X" at time t0 to the servo-controller 11*t* as by step SP14. The servo-controller 11 regulates the driving current signal DR to an appropriate potential level, and supplies the driving current signal DR to the solenoid-operated key actuator 11*a* associated with the key 10*b* to be depressed. The solenoid-operated key actuator 11*a* projects the plunger 11*e* so as to move the key 10*b* to the target key position "X" at time t0.

While the solenoid-operated key actuator 11*a* is projecting the plunger 11*e*, the plunger sensor 11*f* supplies the feedback signal FB1 representative of the current plunger position and, accordingly, the current key position to the servo-controller 11*t*, and the servo-controller 11*t* further regulates the potential level of the driving current signal so as to match the current key position with the target key position "X".

When the motion controller 11*s* supplies the servo-controller 11*t* the positional control data representative of the target key position "X" at time t0, the motion controller 11*s* deletes the front positional data code (t0, X) as by step SP15, and the next positional data code of the same series becomes a new front positional data code (t, X).

The motion controller 11*s* returns to step SP11, and reiterates the loop consisting of steps SP11 to SP15 until the motion controller 11*s* processes all the positional data codes (t, X). When the memory of the pretreatment unit 11*r* becomes empty, the answer at step SP11 is given negative, and the motion controller 11*s* terminates the program sequence.

When a series of positional data (t, X) are representative of the composite trajectory integrated with the first and second linear trajectories at the transit point XT. The positional data codes (t, X) after time tPT represent the key positions given by equation 17, and the servo-controller 11*t* moves the plunger 11*e* along the quadratic curve expressed by equation 17. As a result, the key 10*b* is controlled along the decelerating trajectory.

When the depressed key 10*b* reaches the turning point Xc', the positional data codes (t, X) vary the key position "X" given by equation 21. The servo-controller 11*t* moves the plunger 11*e* along the quadratic curve expressed by equation 21, and the released key 10*b* is controlled along the accelerating trajectory.

When the current time is matched with time tNT, the positional data codes (t, X) represent the key positions given by equation 6, and the servo-controller 11*t* moves the plunger 11*e* along the second linear line. As a result, the released key 10*b* is moved along the second linear trajectory.

When the current time reaches t4, all of the positional data codes (t, X) of the series were read out and processed, and the key 10*b* returns to the rest position. The program sequence shown in FIG. 13 is executed at intervals.

The present inventors evaluate the playback sub-system according to the present invention. The present inventors measured a plunger position, a key position and a hammer position when the prior art playback sub-system controlled the solenoid-operated key actuator. The prior art playback sub-system only controlled the half stroke key along the linear trajectories. The plunger motion, the key motion and the hammer motion were plotted on dot-and-dash lines in FIGS. 14A to 14C. The key motion fluctuated around "Y", because the key motion rapidly changes the direction.

Figure 14A:
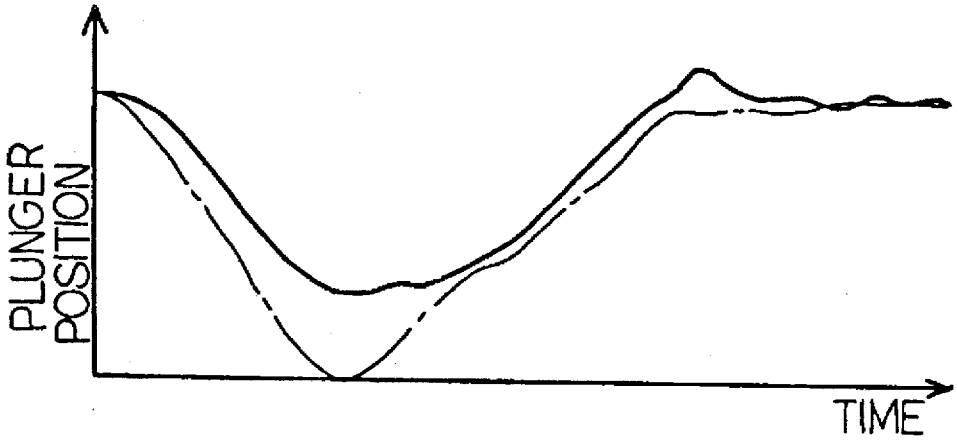
FIG. 14A is a graph showing a plunger position in terms of time.
Figure 14B:
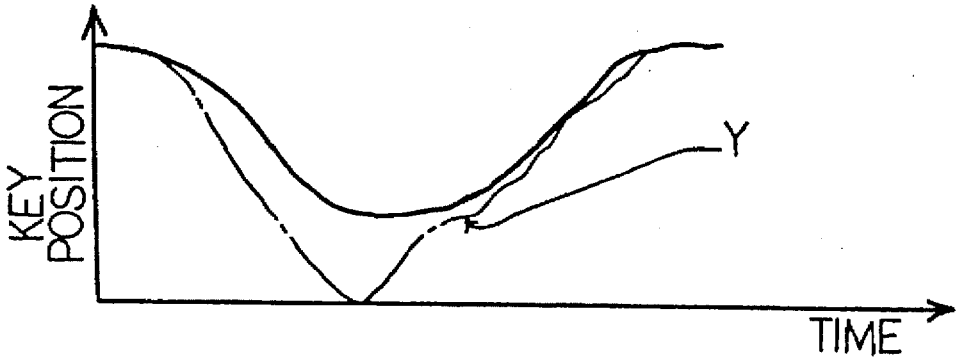
FIG. 14B is a graph showing a key position in terms of time.
Figure 14C:
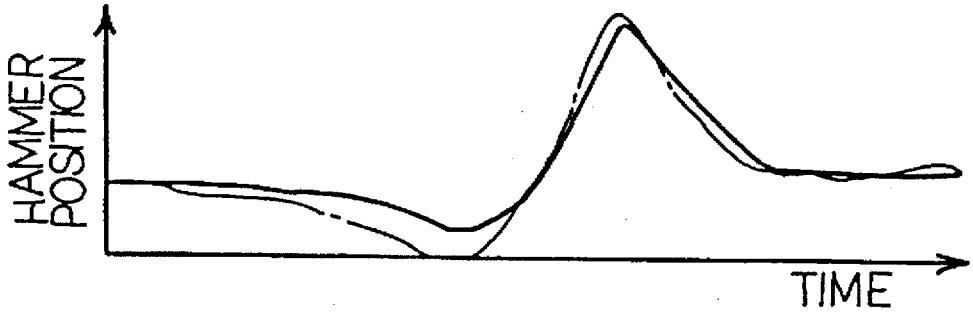
FIG. 14C is a graph showing a hammer position in terms of time.

On the other hand, the plunger motion, the key motion and the hammer motion were represented by real lines in FIGS. 14A to 14C, and the key motion did not fluctuate. If the initial key velocity of the depressed key was small, the hammer motion controlled by the prior art playback sub-system was analogous to the hammer motion controlled by the playback sub-system according to the present invention.

As will be understood from the foregoing description, the automatic player piano according to the present invention can control the key along the decelerating/accelerating trajectories so as to make the key motion smooth. Especially, the servo-controller 11*t* decelerates the key 10*b* toward the turning point Xc', and the key 10*b* does not violently rebound at the turning point Xc'. For this reason, the acoustic piano sound in the playback has the same loudness as that in the original performance, and no piano sound is missing. Moreover, the automatic player piano according to the present invention exactly discriminates a half stroke in the vicinity of the end position, and exactly reproduce the half stroke. Finally, the decelerating trajectory slows down the key motion around the end position, and the key motion is felt natural.

Second Embodiment

Figure 15A:
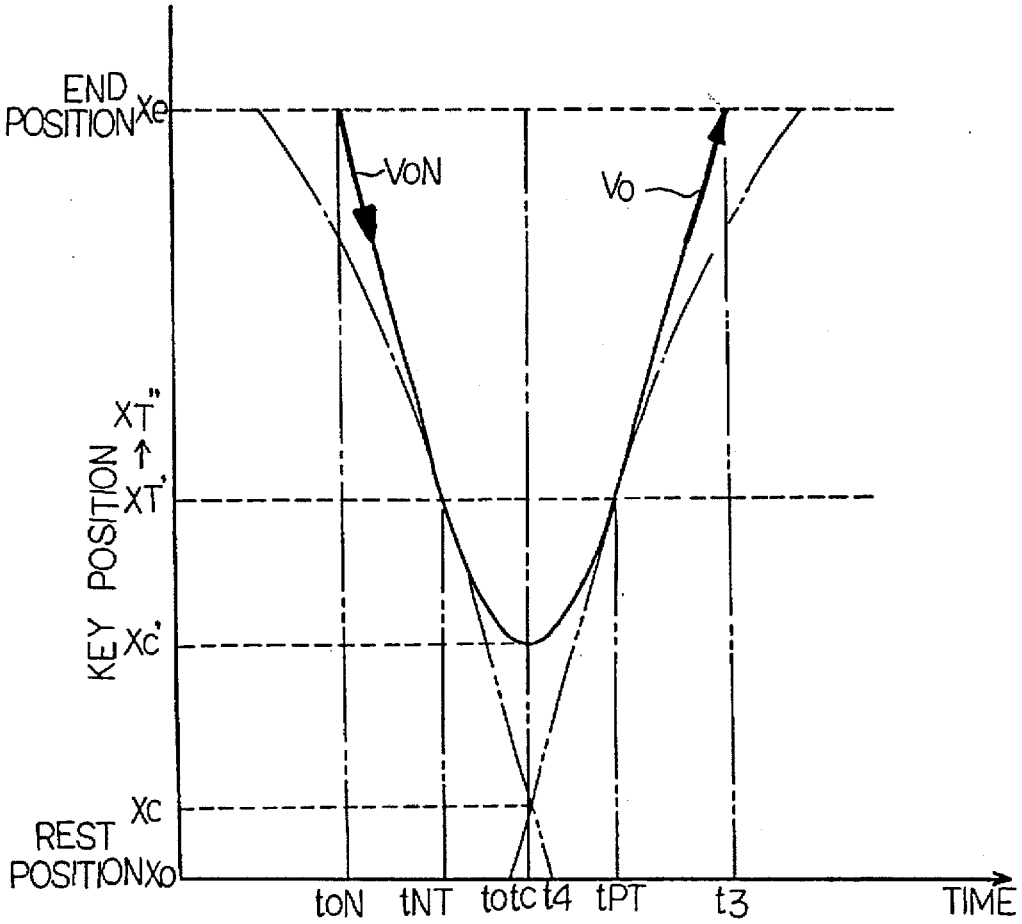
FIG. 15A is a graph showing a trajectory of a half stroke key motion of another automatic player piano.
Figure 15B:
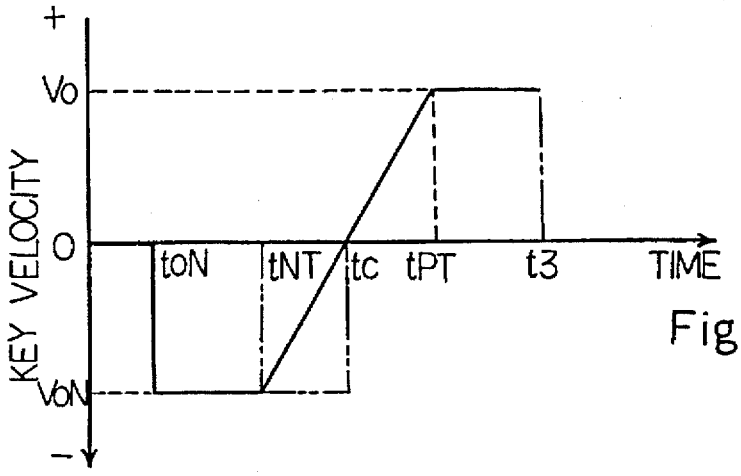
FIG. 15B is a graph showing a key velocity of the half stroke key in terms of time.

Another automatic player piano embodying the present invention also largely comprises an acoustic piano and an automatic playing system. The acoustic piano is similar to that of the first embodiment, and the arrangement of the automatic playing system is analogous to that shown in FIG. 1. For this reason, description is not made on the structure of the acoustic piano and the arrangement of the automatic playing system, and parts and units of the second embodiment are designated by the same references as those of the first embodiment in the following description. FIG. 15A illustrates a trajectory of a half stroke key 10*b* in a playback, and FIG. 15B shows the key velocity along the trajectory. The key 10*b* returns from the end position toward the rest position, and is depressed again on the way to the end position. The trajectory is composed of a first linear section from the end position Xe to a transit point XT', a decelerating section from the transit point XT' to a turning point Xc', an accelerating section from the turning point Xc' to the transit point XT' and a second linear section from the transit point XT' to the end position Xe. The decelerating section and the accelerating section are quadratic curves.

The transit point XT' is closer to the rest position Xo than the transit point XT of the half stroke key 10*b* changing the direction on the way from the rest position toward the end position. If a transit point XT' is changed to a certain position XT" closer to the end position Xe, the turning point Xc' is also changed toward the end position Xe, and the transit point XT" does not allow a player to repeat the key around the end position Xe, because the distance between the turning point Xc and the transit point XT" is too short to make the hammer assembly 10*f* engaged with the key action mechanism 10*e*. Moreover, the transit point XT" retards the timing at which the damper assembly 10*h* is brought into contact with the strings 10*g*. In this instance, the transit point XT' is given around the mid point between the rest position Xo and the end position Xe.

An extension line of the first linear section is assumed to cross an extension line of the second linear section at time tc, and a key 10*b* on the decelerating/accelerating trajectory is controlled in such a manner that the key velocity is decreased to zero at time tc. The key velocity is changed from VoN to zero between time tNT and time tc along the decelerating trajectory and from zero to Vo between time tc and time tPT along the accelerating trajectory. Time tc is given by equation 26.

$$tc=(Vo\times t3-VoN\times toN)/(Vo-VoN) \qquad \text{Equation 26}$$

where t3 represents the timing when the second linear section crosses the end position Xe. Time t3 is given by equation 27.

$$t3=t0-(Xe-Xo)/VoN \qquad \text{Equation 27}$$

The decelerating section is determined as follows. First, a deceleration aN is calculated by using equation 28.

$$aN=-VoN/(tc-tNT) \qquad \text{Equation 28}$$

Therefore, the released key velocity V and the released decelerating section are given by equations 29 and 30.

$$V=VoN+aN(t-tNT) \quad \text{Equation 29}$$

$$X=P3\ t^2+Q3\ t+R3 \quad \text{Equation 30}$$

where t is time and P3, Q3 and R3 are constants. The constants P3, Q3 and R3 are given by substituting specific values in FIG. 15A for "t" of equation 30 and the derivative of equation 30.

On the other hand, an acceleration aP along the accelerating section is calculated as follows.

$$aP=Vo/(tPT-tc) \quad \text{Equation 31}$$

The key velocity V along the accelerating section and the key position XN thereon are given by equations 32 and 33.

$$V=aP(t-tc) \quad \text{Equation 32}$$

$$XN=XN=P4\ t^2+Q4\ T+R4 \quad \text{Equation 33}$$

where P4, Q4 and R4 are constants given by substituting specific values in FIG. 15A for time "t" of equation 33 and the derivative of equation 33.

The pretreatment unit 11*r* decides whether to determine the decelerating/accelerating sections or not as follows. There are three deciding methods.

First, if the crossing point Xc is closer to the end position Xe than the rest position Xo, the decelerating section crosses the accelerating section.

Second, if time t4 at the rest position Xo is later than the time t0 at which the key 10*b* is depressed again, the decelerating section crosses the accelerating section.

Third, if the time tc is earlier than the time t4, the decelerating section crosses the accelerating section. In case where the time tc is later than the time t0, the pretreatment unit 11*r* also decides that the decelerating section crosses the accelerating section.

Figure 16A:
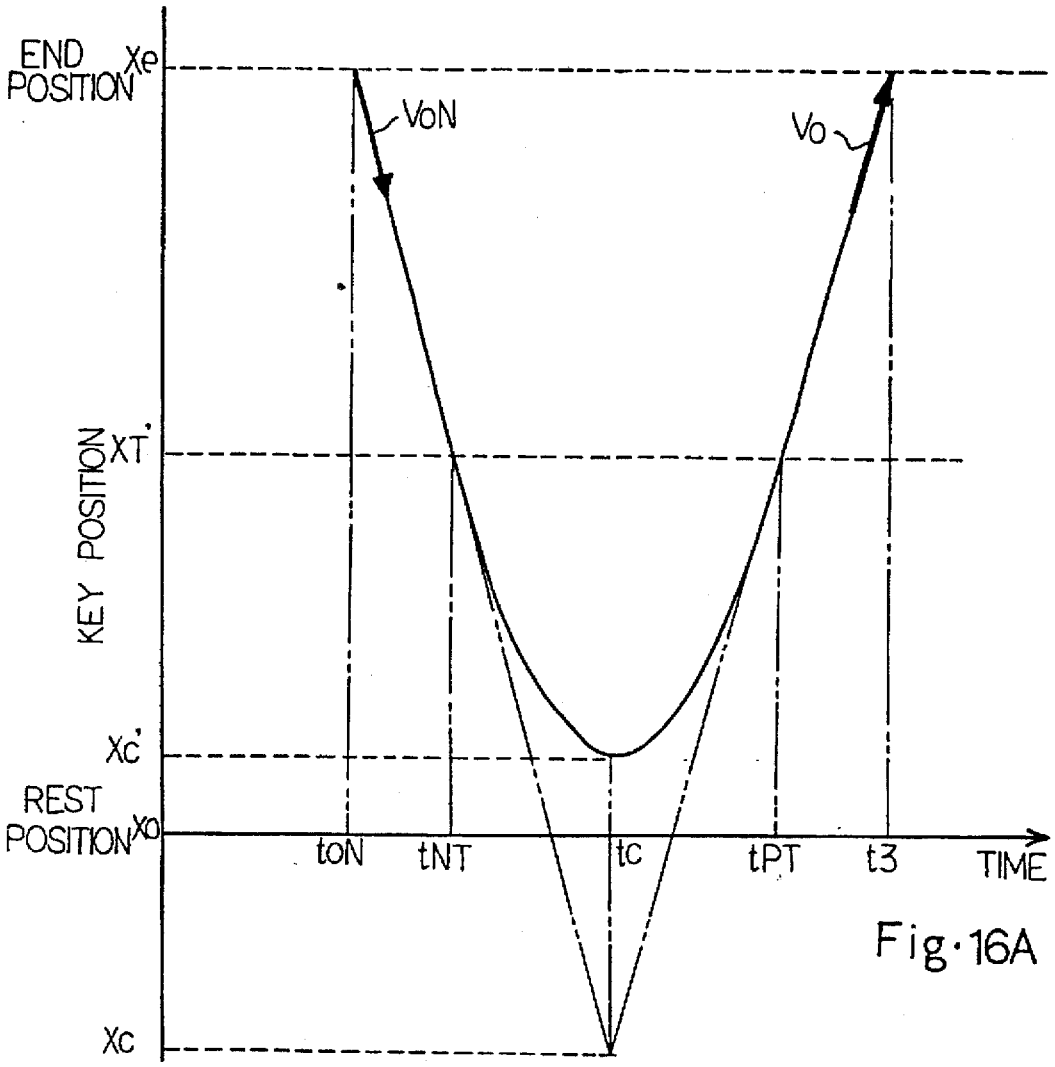
FIG. 16A is a graph showing a trajectory of another half stroke key motion.
Figure 16B:
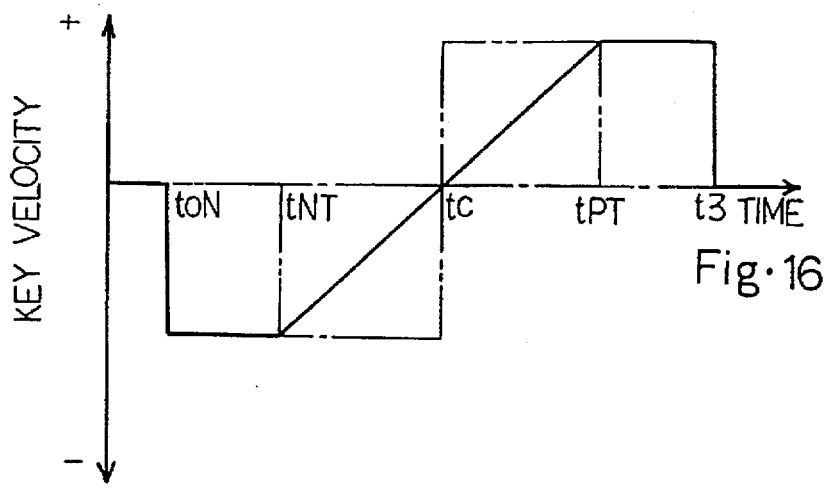
FIG. 16B is a graph showing a key velocity of the half stroke key in terms of time.

Even if a key motion does not satisfy the above conditions, there is a possibility of a half stroke as shown in FIGS. 16A and 16B. The pretreatment unit 11*r* discriminates the half stroke as follows.

First, the turning point Xc' is determined by using equation 35.

$$\begin{aligned} Xc' &= XT-(XT-Xc)/2 \\ &= (Xc+XT)/2 \end{aligned} \quad \text{Equation 35}$$

If the turning point Xc' is closer to the end position than the rest position Xo, the pretreatment unit 11*r* decides that the decelerating section crosses the accelerating section.

Figure 17A:
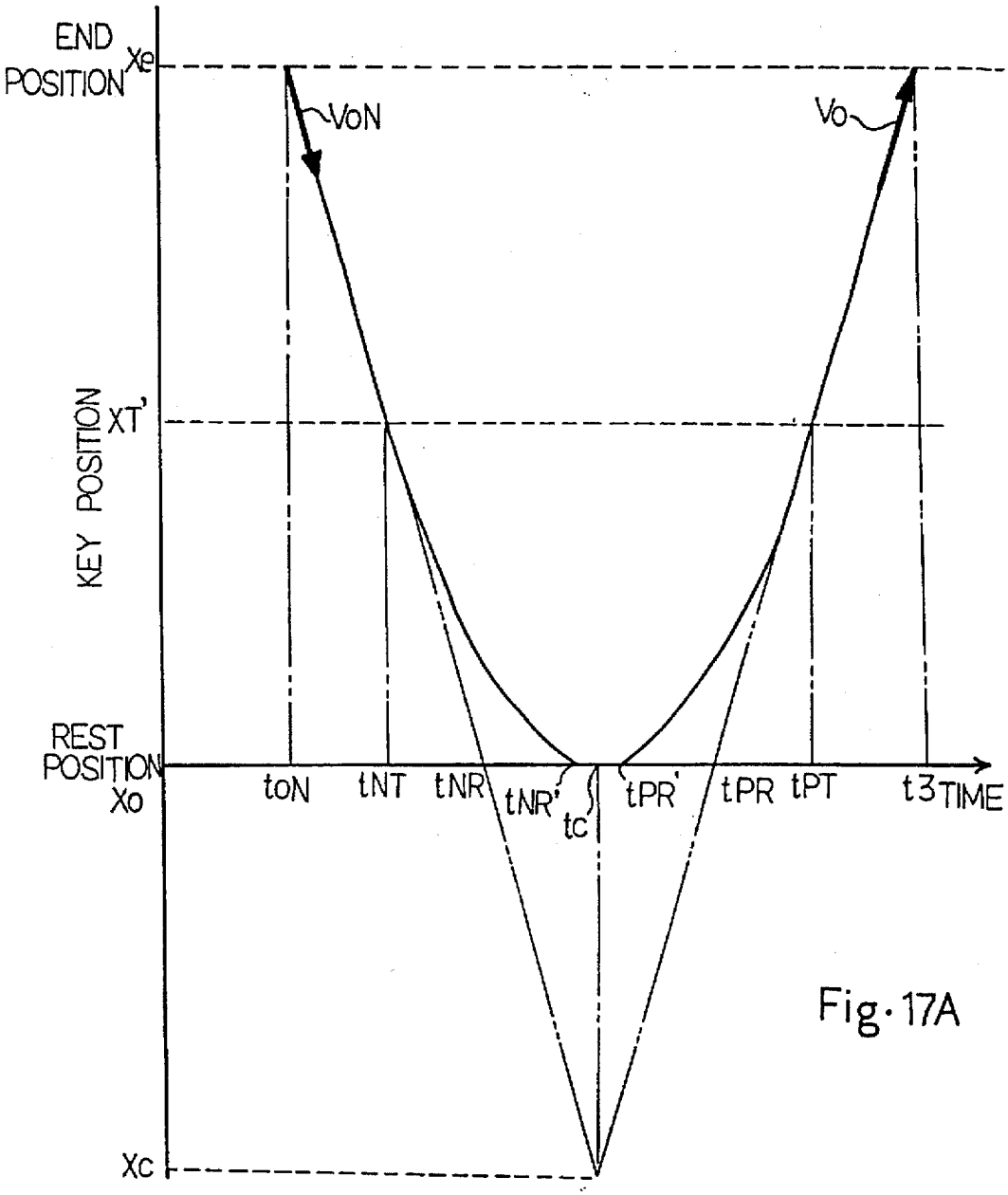
FIG. 17A is a graph showing a trajectory of a non-half stroke key motion.

The pretreatment unit 11*r* may take another method. First, a quadratic curve representative of a decelerating section is assumed to be integrated with a quadratic curve representative of an accelerating section at the rest position Xo, and the key 10*b* on the decelerating section decreases the key velocity to zero at the rest position. If a decelerating section is integrated with an accelerating section over the rest position as shown in FIG. 17, the decelerating section is never integrated with the accelerating section, and time tNR' is earlier than time tPR'. However, if the time tNR' is later than time tPR', the decelerating section would be integrated with the accelerating section. The time tNR' and the time tPR' are given by equations 36 and 37, respectively.

$$tNR'=tNR-(XT-Xo)/VoN \quad \text{Equation 36}$$

$$tPR'=tPR-(XT-Xo)/Vo \quad \text{Equation 37}$$

The pretreatment unit 11*r* may discriminate a half stroke as follows. If the time tc is earlier than the time tNR', the decelerating section is integrated with the accelerating section. If the time tc is later than the time tPR', the decelerating section is also integrated with the accelerating section.

The pretreatment unit 11*r* and the motion controller 11*s* execute the program sequences shown in FIG. 11 to 13. However, step SP2 of the program sequence shown in FIG. 11 is read as "Does music data code represent released key?", and the pretreatment unit checks music data codes to see whether or not a music data code for the same key to be depressed is received at step SP4. The term "first linear trajectory" at step SP3 and the term "second linear trajectory" at step SP5 are read as "first linear section" and "second linear section", respectively.

The playback sub-system 11*o* integrates the first linear section, the decelerating section, the accelerating section and the second linear section with one another, and controls the solenoid-operated key actuators 11*a* so as to reproduce the half stroke key motion. The playback sub-system 11*o* gradually decelerates the key 10*b* toward the turning point Xc', and the key 10*b* does not undesirably rebound or overrun due to the inertia. As a result, the rhythm does not fluctuate, nor an acoustic piano sound is missing.

Even if the pretreatment unit 11*r* decides that an extension line of the first linear section is not integrated with an extension line of the second linear section, the pretreatment unit 11*r* exactly discriminates a deep half stroke, i.e., a transition from a full stroke released key to a depressed key, and the key motion does not fluctuate.

Although particular embodiments of the present invention have been shown and described, it will be obvious to those skilled in the art that various changes and modifications may be made without departing from the spirit and scope of the present invention.

For example, the automatic player piano may further comprises a silent system and an electronic sound generating system. The silent system is changed between a free position and a blocking position. When the silent system is in the free position, the hammer assemblies strike the associated sets of strings. However, if the silent system is changed to the blocking position, the hammer assemblies rebound before a strike at the strings, and the electronic sound system generates electronic sounds instead of the acoustic piano sounds.

Moreover, a key may be moved between the rest/end position and the transit point along non-linear trajectories. An automatic player piano according to the present invention may discriminate both kinds of half-stroke, i.e., a release of a depressed key on the way to the end position and a depressing of a released key on the way to the rest position.

Figure 10A:
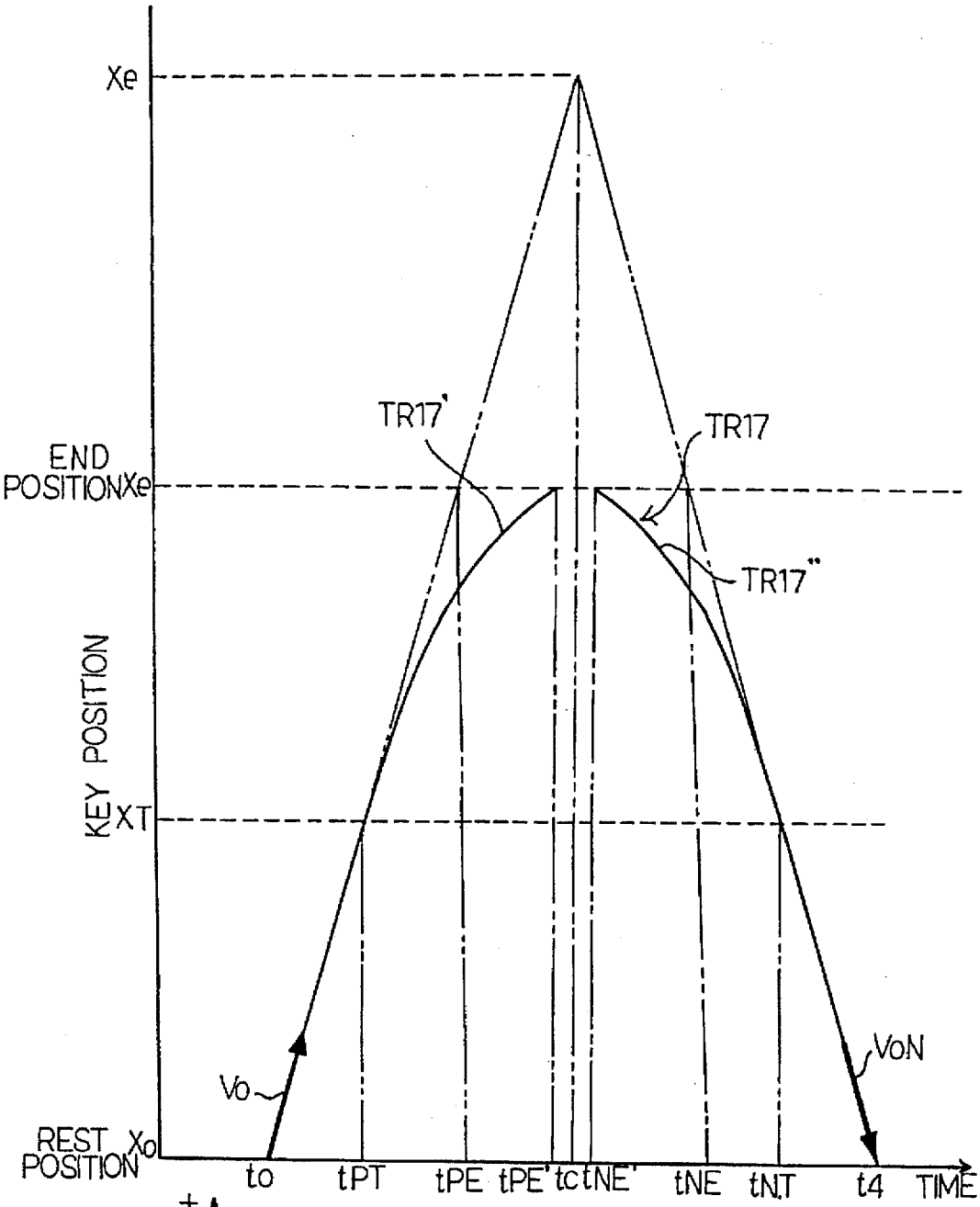
FIG. 10A is a graph showing a composite trajectory in non-half stroke.
Figure 10B:
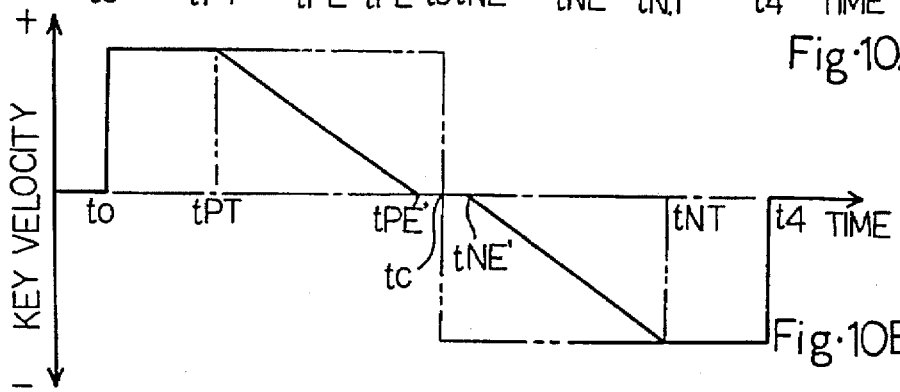
FIG. 10B is a graph showing a key velocity in the non-half stroke in terms of time.

Even if the pretreatment unit decides a decelerating trajectory not to be integrated with an accelerating trajectory, the pretreatment unit may determine the decelerating trajectory and the accelerating trajectory so that the motion controller 11*s* causes the solenoid-operated actuator unit to control the key 10*b* along the decelerating trajectory from the transit point XT to the end position and the accelerating trajectory from the end position to the transit point XT as shown in FIG. 10A. In this instance, the acceleration aP on the decelerating trajectory for the depressed key is calculated by equation 38.

$$aP=-Vo/(tPE'-tPT) \quad \text{Equation 38}$$

Time tPE' is given by equation 24. The released key 10*b* on the accelerating trajectory changes the key velocity from zero to VoN between time tNE' and time tNT. For this reason, the acceleration aN for the released key on the accelerating trajectory is given by equation 39.

$$aN=VoN(tNT-tNE') \quad \text{Equation 39}$$

In order to determine time tNE', a quadratic equation is formed for t from equations 18 to 21. Equation 25 also gives time tNE'.

Thus, the playback sub-system 11*o* can control a depressed key along the decelerating trajectory and a released key along the accelerating trajectory. The decelerating trajectory and the accelerating trajectory enhances the stability of the key motion.

Figure 17B:
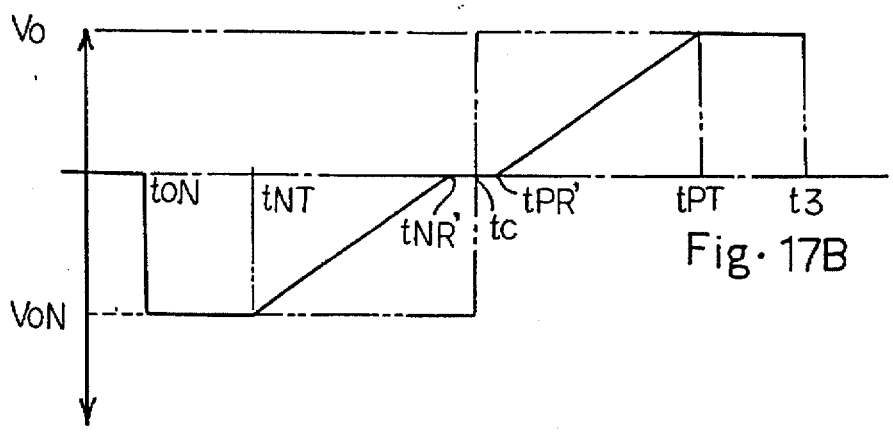
FIG. 17B is a graph showing a key velocity of the non-half stroke key in terms of time.

Similarly, even if the pretreatment unit decides a decelerating section for a released key not to be integrated with an accelerating section for a depressed key, the pretreatment unit may control the key along the decelerating section and the accelerating section. In this instance, as shown in FIG. 17B, the released key 10*b* changes the key velocity from Von to zero along the decelerating trajectory between time tNT and time tNR'. On the other hand, the depressed key 10*b* changes the key velocity from zero to Vo along the accelerating trajectory between time tPR' and time tPT.

In the above described embodiments, the motion of a depressed key to the transit point and the motion of a released key from the transit point are assumed to be uniform motions. However, these key motions may be assumed to be quadratic curves as indicated by dot-and-dash lines in FIGS. 8A and 15A. In this case, the quadratic trajectory is expressed by equation 40.

$$X=at^2+bt+c \quad \text{Equation 40}$$

where a is an acceleration estimated on the basis of key velocities at different two points, b and c are coefficients calculated on the basis of the time t0 and the initial velocity Vo. A quadratic trajectory for the released key is determined as similar to the quadratic trajectory for the depressed key. The quadratic trajectories make the key motion further close to the original key motion.

The composite trajectory is not limited to the quadratic curves. The transit motion may be simulated to any kind of curve such as a circular orbit, an elliptical function or a polygonal line in so far as the curve does not reach the crossing point Xc.

A linear trajectory for a depressed key may be integrated with an accelerating trajectory for a released key, and a decelerating trajectory for a depressed key may be integrated with a linear trajectory for a released key. A linear trajectory for a released key may be integrated with an accelerating trajectory for a depressed key, and a decelerating trajectory for a released key may be integrated with a linear trajectory for a depressed key.

In the above embodiment, the pretreatment unit 11*r* produces a series of positional data (t, X), and the motion controller 11*s* and the servo-controller cause the solenoid-operated key actuator 11*a* to change the key position "X" through a feed-back control. However, a pretreatment unit may produce a series of velocity data (t, V). In this instance, the associated motion controller instructs an initial velocity "V" to the servo-controller, and the servo-controller regulates the actual key velocity to a target velocity.

In the above embodiment, the playback sub-system 11*o* reproduces a kinetic attribute such as, for example, a key velocity at the reference point. However, a playback sub-system may not take the reference point into account, and simply determines linear trajectories for depressed/released keys so as to move the key through a servo-control.

The upright piano is used for the above described embodiment. A grand piano may be incorporated in the automatic player piano according to the present invention.

What is claimed is:

1. An automatic player piano comprising:

an acoustic piano including a keyboard having a plurality of keys respectively assigned notes of a scale and turnable between respective rest positions and respective end positions when a player selectively depresses and releases through a fingering, a plurality of vibrating means respectively associated with said plurality of keys for generating acoustic sounds with notes of said scale assigned to depressed keys, a plurality of hammer assemblies respectively associated with said plurality of vibrating means so as to cause vibrating means associated with said depressed keys to generate said acoustic sounds, a plurality of key action mechanisms coupled between said plurality of keys and said plurality of hammer assemblies, and selectively actuated by said depressed keys so as to selectively cause said plurality of hammer assemblies to strike said plurality of hammer assemblies, and a plurality of damper assemblies respectively associated with said plurality of vibrating means and selectively brought into contact with said vibrating means at respective return points for absorbing vibrations after said depressed keys are released; and an automatic playing system including a plurality of key actuators respectively associated with said plurality of keys and responsive to driving signals so as to cause said plurality of keys to selectively turn without said fingering, a playback sub-system responsive to music data codes containing a first piece of data information representative of one of said plurality of keys, a second piece of data information representative of a hammer velocity expected to associated one of said plurality of hammer assemblies, a third piece of data information representative of an impact timing of said one of said hammer assemblies against associated one of said vibrating means, a fourth piece of data information representative of a key velocity of said one of said plurality of keys on the way toward the rest position and a fifth piece of data information representative of a return time when associated one of said plurality of damper assemblies is brought into contact with said associated one of said plurality of vibrating means for generating one of said driving signal, said playback sub-system having a first trajectory generating means responsive to said second to fifth pieces of data information for determining a first trajectory from the rest position through a transit point to the end position and a second trajectory from said end position through said transit point to said rest position, a second trajectory generating means for producing a decelerating trajectory integral with said first trajectory at said transit point and an accelerating trajectory integral with said second trajectory at said transit point on the basis of said second to fifth pieces of data information, a judging means for deciding whether or not said decelerating trajectory crosses said accelerating trajectory before said one of said plurality of keys reaches said end position, a composing means for producing a composite trajectory having said decelerating trajectory integral with said accelerating trajectory at a turning point where said one of said plurality of keys changes the direction of a motion when said judging means decides said decelerating trajectory crosses said accelerating trajectory, and a driving current supplying means for producing said driving signals, each of said driving signals being representative of said first and second trajectories when said judging means decides that said decelerating trajectory does not cross said accelerating trajectory, each of said driving signals being representative of a composite trajectory integral with a part of said first trajectory and a part of said second trajectory at said transit point when said composing means produces said composite trajectory.

2. The automatic player piano as set forth in claim 1, in which said first trajectory and said second trajectory are expressed by linear functions, respectively.

3. The automatic player piano as set forth in claim 1, in which said decelerating trajectory and said accelerating trajectory are expressed by quadratic functions.

4. The automatic player piano as set forth in claim 1, in which said first and second trajectories are expressed by linear functions, respectively, and said decelerating and accelerating trajectories are expressed by quadratic functions, respectively.

5. The automatic player piano as set forth in claim 4 in which said judging means decides that said decelerating trajectory is integrated with said accelerating trajectory when one of first to third conditions is satisfied;

said first condition is that said first trajectory crosses said second trajectory between said transit point and said rest position or said end position, said second condition is that said first trajectory reaches said end position or said rest position later than said second trajectory starts said end position or said rest position, and said third condition is that said first trajectory crosses said second trajectory earlier than said first trajectory reaches said end position or said rest position.

6. The automatic player piano as set forth in claim 5, in which, even if said first to third conditions are not satisfied, said judging means decides that said decelerating trajectory is integrated with said accelerating trajectory when said decelerating trajectory is integrated with said accelerating trajectory at an integrating point between said transit point and said end position or said rest position, said integrating point is given by one of the following equations $$Xc'=(Xc+XT)/2$$

where Xc' is said integrating point, Xc is a crossing point between said first trajectory and said second trajectory and XT is said transit point.

7. The automatic player piano as set forth in claim 1, in which said automatic player system further includes a recording sub-system for generating a set of music data codes containing said first to fifth pieces of data information representative of a plurality of key motions during said fingering.

8. The automatic player piano as set forth in claim 7, in which said automatic playing system further includes a plurality of hammer sensors respectively associated with said plurality of hammer assemblies for supplying hammer position signals each indicative of a current hammer position to said recording system, and a plurality of key sensors respectively associated with said plurality of keys for supplying key position signals each indicative of a current key position, and said recording sub-system obtains said first to third pieces of data information from each hammer position signal and said first, fourth and fifth pieces of data information from each key position signal.

* * * * *